US011648447B2

(12) United States Patent
Brown et al.

(10) Patent No.: US 11,648,447 B2
(45) Date of Patent: May 16, 2023

(54) LACROSSE HEAD POCKET STRINGING SYSTEMS AND METHODS

(71) Applicant: Wm. T. Burnett IP, LLC, Baltimore, MD (US)

(72) Inventors: Austin Scott Brown, Glen Rock, PA (US); Michael F. O'Brien, Brooklyn, NY (US)

(73) Assignee: Wm. T. Burnett IP, LLC, Baltimore, MD (US)

( * ) Notice: Subject to any disclaimer, the term of this patent is extended or adjusted under 35 U.S.C. 154(b) by 79 days.

(21) Appl. No.: 16/938,174

(22) Filed: Jul. 24, 2020

(65) Prior Publication Data

US 2022/0023729 A1 Jan. 27, 2022

(51) Int. Cl.
*A63B 59/20* (2015.01)
*A63B 102/14* (2015.01)

(52) U.S. Cl.
CPC ..... *A63B 59/20* (2015.10); *A63B 2102/14* (2015.10)

(58) Field of Classification Search
CPC ..... A63B 59/20; A63B 2102/14; A63B 60/50; A63B 51/12; A63B 2102/02; A63B 49/022; A63B 51/02
See application file for complete search history.

(56) References Cited

U.S. PATENT DOCUMENTS 1,559,986 A * 11/1925 Quick ..... A63B 51/12 473/534
2,204,939 A * 6/1940 Lyons ..... H01R 13/72 242/388.2
2,605,000 A * 7/1952 Tomarin ..... A47G 25/743 211/113
2,710,753 A * 6/1955 Lockwood ..... A63B 49/02 473/513
2,884,249 A 4/1959 Cunningham
3,507,495 A 4/1970 Tucker et al.
3,664,669 A * 5/1972 Latham ..... A63B 49/03 473/541

(Continued)

OTHER PUBLICATIONS

Ambler, Jordan. @jambler13 #StringLeagueSeason3entry ©stringleague, Instagram Posts, Mar. 17, 2017 (5 pp). Retrieved from Internet: <https://www.instagram.com/jambler13/?hl=en>.

(Continued)

*Primary Examiner* — Alvin A Hunter
*Assistant Examiner* — Amir A Klayman
(74) *Attorney, Agent, or Firm* — Plumsea Law Group, LLC

(57) ABSTRACT

Embodiments provide a lacrosse head having a pocket stringing system that includes attachment members that allow for rapid, direct attachment of a pocket to the head. A lacrosse head may include cleats protruding from the sidewalls at a rearward portion of the pocket area nearest the juncture, sidewall hooks protruding from the sidewalls at a forward portion of the pocket area forward of the rearward portion, and scoop hooks protruding in the forward direction from the front face of the scoop. Each cleat may have a rearwardly-projecting arm and a forwardly-projecting arm. Each sidewall hook may have a rearwardly-projecting arm. A first scoop hook may tension a pocket toward a first sidewall hook on a first sidewall, and a second scoop hook may tension the pocket toward a second sidewall hook on a second sidewall, so as to form a ball channel in the pocket.

23 Claims, 26 Drawing Sheets

(56) References Cited

U.S. PATENT DOCUMENTS 3,724,850 A * 4/1973 Stevens ..... A63B 51/12 473/534
3,781,761 A * 12/1973 Harwood ..... H01R 13/6392 439/369
3,966,207 A 6/1976 Pass
4,034,984 A * 7/1977 Crawford ..... A63B 59/20 473/513
4,049,273 A * 9/1977 Pool ..... A63B 51/02 473/513
4,097,046 A * 6/1978 Friant ..... A63B 59/20 473/513
4,118,029 A * 10/1978 Septier ..... A63B 51/12 473/534
4,138,111 A 2/1979 Rule
4,241,916 A * 12/1980 Palm ..... A63B 63/083 24/115 K
D263,249 S 3/1982 Rule
D263,624 S * 3/1982 Stenzler ..... D24/128
D275,262 S * 8/1984 Kimball ..... D8/356
D277,691 S 2/1985 Rule
4,566,695 A * 1/1986 Melby ..... A63B 49/022 473/534
4,861,042 A * 8/1989 Trettin ..... A63B 59/20 473/513
5,082,290 A * 1/1992 Tucker ..... A63B 59/20 473/513
5,098,091 A 3/1992 McGivern
5,178,397 A * 1/1993 Brine, Jr. ..... A63B 49/022 473/513
5,494,297 A 2/1996 MacNeil
5,566,947 A 10/1996 Tucker et al.
5,582,524 A 12/1996 Sanner et al.
D380,115 S * 6/1997 Fairweather ..... D6/552
5,918,837 A * 7/1999 Vicain ..... H02G 3/26 174/72 A
5,951,416 A * 9/1999 Allen ..... A63B 63/083 473/489
6,066,056 A 5/2000 Morrow
6,118,075 A * 9/2000 Baker ..... H04Q 1/06 52/712
6,312,350 B1 * 11/2001 White ..... A63B 63/083 473/486
D468,996 S * 1/2003 Sarkinen ..... D8/356
6,503,160 B2 1/2003 Hehr
6,506,132 B1 1/2003 Brine, III et al.
6,723,134 B2 4/2004 Tucker, Sr.
6,764,417 B1 * 7/2004 Filippini ..... A63B 49/022 473/540
6,852,047 B2 * 2/2005 Tucker, Sr. ..... A63B 60/50 473/513
6,916,259 B2 7/2005 Kohler et al.
6,923,739 B2 8/2005 Gait et al.
7,081,004 B1 * 7/2006 Puzio ..... H01R 13/5833 439/369
7,094,167 B2 * 8/2006 Tucker, Sr. ..... A63B 60/50 473/513
7,101,294 B2 9/2006 Tucker, Sr.
7,131,919 B2 * 11/2006 Kohler ..... A63B 49/035 473/513
7,150,691 B2 * 12/2006 Gait ..... A63B 59/20 473/513
7,396,302 B1 7/2008 Boudreau
D589,782 S * 4/2009 Rowell ..... D8/356
7,727,092 B2 6/2010 Lignelli et al.
7,815,531 B1 * 10/2010 Gait ..... A63B 59/20 473/513
8,075,428 B2 * 12/2011 Gait ..... A63B 49/022 473/513
D657,460 S * 4/2012 Uhlenkamp ..... D24/128
8,267,813 B2 * 9/2012 Vestuti ..... A63B 49/10 473/513
D670,347 S 11/2012 Goudy et al.
8,342,459 B2 * 1/2013 Garrison ..... H01R 12/63 248/68.1
8,663,038 B2 * 3/2014 Bowman ..... A63B 63/08 473/485
9,265,498 B2 * 2/2016 Fallin ..... A61B 17/0401
9,370,700 B2 * 6/2016 Regan ..... A63B 59/20
D777,254 S * 1/2017 Condren ..... D19/65
10,493,339 B2 12/2019 Gait et al.
2004/0118982 A1 * 6/2004 Shillings ..... F16L 3/223 248/68.1
2011/0147542 A1 * 6/2011 Hoek ..... F16L 3/223 248/68.1
2017/0021244 A1 1/2017 Colchie
2017/0232315 A1 8/2017 Brown
2022/0023729 A1 1/2022 Brown et al.

OTHER PUBLICATIONS

Gait Torque 3 Lacrosse Head, Lax Room, Dec. 28, 2019 (3 pp). Retrieved from Internet: <https://web.archive.org/web/20191228203616/http://www.laxroom.com/post/category/10390/Gait/listings/519/Gait-Torque-3-Lacrosse-Head.html>.
Gait Torque Lacrosse Head, Lacrosse Gear Review, Nov. 25, 2014 (10 pp). Retrieved Jul. 29, 2020 from Internet: <https://web.archive.org/web/20141125082055/http://www.lacrossegearreview.com/heads/gait-torque-lacrosse-head-24219>.
Review: Gait Torque, Lacrosse Playground, Jun. 11, 2010 (2 pp). Retrieved Jul. 29, 2020 from Internet: <https://www.lacrosseplayground.com/review-gait-torque/>.
Gait Torq Unstrung Lacrosse Head, Lacrosse Monkey, Jan. 27, 2020 (2 pp). Retrieved Jul. 30, 2020 from Internet: <https://www.lacrossemonkey.com/gait-lacrosse-unstrung-head-torq.html>.
Torque Pro With Jama Hard, The Lacrosse Forum, Inside Lacrosse, Dec. 13, 2007 (7 pp). Retrieved Jul. 30, 2020 from Internet: <https://forums.insidelacrosse.com/threads/torque-pro-with-jama-hard.103792/>.
NCAA Women's Lacrosse 2020 and 2021 Rules Book, Nov. 2019 (117 pp).
NCAA Men's Lacrosse 2019 and 2020 Rules, Nov. 5, 2019 (102 pp). Retrieved from Internet: <http://www.ncaapublications.com/productdownloads/LC20_20191111.pdf>.
Office Action dated Mar. 11, 2022 in U.S. Appl. No. 29/749,997.
Lacrosse Head Search; Google.com; Feb. 16, 2022; from U.S. Appl. No. 29/749,997.

* cited by examiner

LACROSSE HEAD POCKET STRINGING SYSTEMS AND METHODS

BACKGROUND

Field

The present embodiments relate generally to lacrosse equipment, and more particularly, to a lacrosse head having a system of specially-configured and strategically-located attachment members for securing a pocket directly to the head with minimal or no separate stringing members, and for forming the pocket into a desired pocket shape.

Background

Lacrosse players favor lacrosse stick head pockets that provide control in catching, throwing, and cradling a lacrosse ball. Characteristics of a pocket that affect such performance include the shape, structure, and tension of the stringing materials. Typically, preferred pockets provide a structure that guides a ball into and out of the pocket along a centerline of the lacrosse head, for accuracy in catching and throwing.

Attaching and shaping a pocket can be a challenging and time-consuming task, involving routing a stringing member, such as a top string or a sidewall string, through stringing openings in the lacrosse head frame and through openings in the pocket (e.g., diamond openings in a mesh pocket), often in complicated patterns requiring multiple steps and repeated adjustments to length and tension. Often, players must rely on instruction manuals and online tutorials to install a pocket. Even after installation, the stringing members require constant monitoring and adjustment to compensate for material stretching and the loosening of knots. And, the stringing members increase the cost of a lacrosse stick, and are another component subject to wear and failure.

SUMMARY

Embodiments provide a lacrosse head having a pocket stringing system that includes attachment members that allow for rapid, direct attachment of a pocket to the head, without requiring additional stringing members on the scoop or sidewalls, and without requiring the tying of stringing members to the scoop or sidewalls. The attachment members may be integral with the remaining portions of a lacrosse head, and may be configured on the lacrosse head to pull stringing members of the pocket into a desired pocket shape. In embodiments, the attachment members may obviate the need for sidewall stringing holes, which tend to be the most difficult elements to navigate in conventional stringing systems. In embodiments, the attachment members may also allow for different positions of the deepest part of a pocket, including a rearward position, an intermediate position, and a forward position (sometimes referred to respectively as a low pocket, a mid-pocket, and a high pocket). The attachment members may therefore provide an intuitive "plug and play" pocket stringing system for which users need minimal knowledge of stringing to install and shape a pocket, while still allowing more experienced players variability in pocket design.

An embodiment may provide a lacrosse head having a juncture, a stop member, a first sidewall, a second sidewall, and a scoop. The juncture may be configured to receive a handle, and may define a bisecting line when the lacrosse head is viewed from a front view. The stop member may adjoin the juncture. The first sidewall may extend from the stop member in a forward direction and may have a first lower portion when viewed from the side view. The second sidewall may extend from the stop member in the forward direction and may have a second lower portion when viewed from the side view. The scoop may connect the first sidewall and the second sidewall opposite to the stop member, and may have an upwardly facing front face and a downwardly facing rear face. The stop member, the scoop, the first sidewall, and the second sidewall may form a pocket area extending in a rearward-to-forward direction from a first point on the stop member at the bisecting line to a second point at a distal edge of the scoop at the bisecting line. The adjoining scoop and first sidewall may form a first shoulder portion of the lacrosse head and the adjoining scoop and second sidewall may form a second shoulder portion of the lacrosse head. A plurality of first cleats may protrude from the first lower portion of the first sidewall at a rearward portion of the pocket area nearest the juncture, with each first cleat having a rearwardly-projecting arm and a forwardly-projecting arm. A plurality of second cleats may protrude from the second lower portion of the second sidewall at the rearward portion of the pocket area nearest the stop member, with each second cleat having a rearwardly-projecting arm and a forwardly-projecting arm. A plurality of first sidewall hooks may protrude from the first lower portion of the first sidewall at a forward portion of the pocket area forward of the rearward portion, with each first sidewall hook having a rearwardly-projecting arm. A plurality of second sidewall hooks may protrude from the second lower portion of the second sidewall at the forward portion of the pocket area forward of the rearward portion, with each second sidewall hook having a rearwardly-projecting arm. A plurality of scoop hooks may protrude in the forward direction from the front face of the scoop, and may include a first lateral scoop hook disposed on a first side of the bisecting line nearest the first sidewall, and a second lateral scoop hook disposed on a second side of the bisecting line nearest the second sidewall. The first lateral scoop hook may be configured to tension a pocket toward a first sidewall hook of the plurality of first sidewall hooks, and the second lateral scoop hook may be configured to tension the pocket toward a second sidewall hook of the plurality of second sidewall hooks, so as to form a ball channel in the pocket.

In an aspect, the plurality of scoop hooks may include a third lateral scoop hook disposed on the first side farther from the bisecting line than the first lateral scoop hook and a fourth lateral scoop hook disposed on the second side farther from the bisecting line than the second lateral scoop hook. The third lateral scoop hook may be configured to tension the pocket toward a second adjacent first sidewall hook positioned adjacent to and forward of the first sidewall hook, and the fourth lateral scoop hook may be configured to tension the pocket toward a second adjacent second sidewall hook positioned adjacent to and forward of the second sidewall hook.

In another aspect, the plurality of scoop hooks may include a center scoop hook disposed on the bisecting line. The center scoop hook may be configured to tension the pocket toward a rearwardmost first sidewall hook positioned nearest the juncture and toward a rearwardmost second sidewall hook positioned nearest the juncture.

In another aspect, moving in the rearward-to-forward direction, each first sidewall hook of the plurality of first sidewall hooks may have a width narrower than a next adjacent first sidewall hook.

In another aspect, each first cleat of the plurality of first cleats and each second cleat of the plurality of second cleats may comprise an inverted T-shaped protrusion when viewed from the side view.

In another aspect, each of the rearwardly-projecting arm and the forwardly-projecting arm of each first cleat of the plurality of first cleats may have an angled distal edge such that adjacent first cleats define a gap that decreases in size in an upward direction when viewed from the side view.

In another aspect, the angled distal edge may comprise a deflectable portion.

In another aspect, each first sidewall hook of the plurality of first sidewall hooks may have a straight side on a forward side of the each first sidewall hook such that the each first sidewall hook may comprise an L-shaped protrusion when viewed from the side view.

In another aspect, each scoop hook of the plurality of scoops may define a string-retaining gap between a downwardly-facing rear face of the each scoop hook and the upwardly-facing front face of the scoop.

In another aspect, the scoop may define an opening under the downwardly-facing rear face of the each scoop hook.

In another aspect, a rearwardmost first cleat of the plurality of first cleats may be wider than remaining first cleats of the plurality of first cleats, and a rearwardmost second cleat of the plurality of second cleats may be wider than a remaining second cleat of the plurality of second cleats.

In another aspect, the stop member may define a plurality of stop member cleats protruding downwardly from a lower edge of the stop member, with each stop member cleat having a first arm on a first side of a base portion of the stop member cleat and a second arm a second side of the base portion of the stop member, wherein the second side of the base portion is opposite to the first side of the base portion.

In another aspect, when viewed from the side view, each first cleat of the plurality of first cleats may protrude vertically downward from a lower edge of the lower portion of the first sidewall.

In another aspect, when viewed from the side view, each first cleat of the plurality of first cleats may protrude vertically upward from a lower rail of the lower portion of the first sidewall.

In another aspect, when viewed from the side view, each of the first cleat of the plurality of first cleats may protrude horizontally from the lower portion of the first sidewall.

In another aspect, the lower portion of the first sidewall may define an opening adjacent to the each first cleat, and the opening may be configured to receive a stringing member loop of the pocket that passes through the opening and then wraps around the each first cleat.

In another aspect, the lacrosse head may further comprise a first anchoring means and a second anchoring means. The first anchoring means may protrude from the first shoulder portion, and may have a forwardly-projecting arm. The second anchoring means may protrude from the second shoulder portion, and may have a forwardly-projecting arm.

In another aspect, the scoop may have an undercut that defines a passageway from the first anchoring means to the upwardly-facing front face of the scoop. The passageway may be configured to route a stringing member of the pocket from the first anchoring means at the first lower portion of the first sidewall to a scoop hook of the plurality of scoop hooks that is closest to the first anchoring means.

In another aspect, the lacrosse head may further comprise the pocket. The first anchoring means may be disposed within a first corner opening of a first row and a first column of openings of the pocket. The second anchoring means may be disposed within a second corner opening of the first row and a second column of openings of the pocket. Each scoop hook of the plurality of scoop hooks may be disposed within a different intermediate opening of a plurality of intermediate openings of the first row of openings between the first corner opening and the second corner opening. Each of the plurality of first sidewall hooks and the plurality of first rearward cleats may be disposed within a different opening of the first column of openings. Each of the plurality of second sidewall hooks and the plurality of second rearward cleats may be disposed within a different opening of the second column of openings.

Another embodiment may provide a lacrosse having a juncture, a stop member, a first sidewall, a second sidewall, and a scoop. The juncture may be configured to receive a handle, and may define a bisecting line when the lacrosse head is viewed from a front view. The stop member may adjoin the juncture. The first sidewall may extend from the stop member in a forward direction and may define a first lower portion when viewed from the side view. The second sidewall may extend from the stop member in the forward direction and may define a second lower portion when viewed from the side view. The scoop may connect the first sidewall and the second sidewall opposite to the stop member, and may have an upwardly facing front face and a downwardly facing rear face. The stop member, the scoop, the first sidewall, and the second sidewall may form a pocket area extending in a rearward-to-forward direction. A plurality of cleats may be disposed on the first and second sidewalls in a rearward cleat zone of the pocket area, with each cleat having a cleat base portion, a first arm extending from a rearward side of the cleat base portion, and a second arm extending from a forward side of the cleat base portion. A plurality of sidewall hooks may be disposed on the first and second sidewalls in a sidewall hook zone of the pocket area disposed forward of the rearward cleat zone. Each sidewall hook may have a sidewall hook base portion and a hook arm extending from a rearward side of the sidewall hook base portion. A plurality of scoop hooks may protrude in the forward direction from the front face of the scoop. Each cleat of the plurality of cleats may be configured to hold a stringing member of a pocket wrapped around the cleat base portion and within the first arm and the second arm such that the plurality of cleats forms a ball-retaining pocket portion of the pocket. The plurality of scoop hooks may be configured to pull stringing members of the pocket against the rearward sides of the sidewall hook base portions and within the hook arms, so as to tension the pocket between the scoop and the sidewall hook zone and form in the pocket a ball channel that narrows in the rearward-to-forward direction from a rearward side of the sidewall hook zone to the scoop.

In an aspect, each cleat may be T-shaped and each sidewall hook may have a straight side on a forward side of the sidewall hook base portion to define an L-shape. A quantity of the plurality of scoop hooks may be equal to a total quantity of sidewall hooks minus one. One scoop hook of the plurality of scoop hooks may be disposed on the bisecting line and provide tension between itself and a rearwardmost sidewall hook on each of the first sidewall and the second sidewall.

Another embodiment may provide a method for lacrosse head pocket stringing involving providing a pocket having an array of openings and providing a lacrosse head having a juncture, a stop member, a first sidewall, a second sidewall, and a scoop. The juncture may be configured to receive a handle, and may define a bisecting line when the lacrosse head is viewed from a front view. The stop member may adjoin the juncture. The first sidewall may extend from the stop member in a forward direction and may have a first lower portion when viewed from the side view. The second sidewall may extend from the stop member in the forward direction and may have a second lower portion when viewed from the side view. The scoop may connect the first sidewall and the second sidewall opposite to the stop member, and may have an upwardly facing front face and a downwardly facing rear face. The stop member, the scoop, the first sidewall, and the second sidewall may form a pocket area extending in a rearward-to-forward direction from a first point on the stop member at the bisecting line to a second point at a distal edge of the scoop at the bisecting line. The adjoining scoop and first sidewall may form a first shoulder portion of the lacrosse head and the adjoining scoop and second sidewall may form a second shoulder portion of the lacrosse head. A plurality of first cleats may protrude from the first lower portion of the first sidewall at a rearward portion of the pocket area nearest the juncture, with each first cleat having a rearwardly-projecting arm and a forwardly-projecting arm. A plurality of second cleats may protrude from the second lower portion of the second sidewall at the rearward portion of the pocket area nearest the stop member, with each second cleat having a rearwardly-projecting arm and a forwardly-projecting arm. A plurality of first sidewall hooks may protrude from the first lower portion of the first sidewall at a forward portion of the pocket area forward of the rearward portion, with each first sidewall hook having a rearwardly-projecting arm. A plurality of second sidewall hooks may protrude from the second lower portion of the second sidewall at the forward portion of the pocket area forward of the rearward portion, with each second sidewall hook having a rearwardly-projecting arm. A first anchoring means may protrude from the first shoulder portion, with the first anchoring means having a rearwardly-projecting arm and a forwardly-projecting arm. A second anchoring means may protrude from the second shoulder portion, with the second anchoring means having a rearwardly-projecting arm and a forwardly-projecting arm. A plurality of scoop hooks may protrude in the forward direction from the front face of the scoop, and may include a first lateral scoop hook disposed on a first side of the bisecting line nearest the first sidewall, and a second lateral scoop hook disposed on a second side of the bisecting line nearest the second sidewall. The method may further involve attaching to the first anchoring means a first stringing member defining a first corner opening of a first row and a first column of openings of the pocket, attaching to the second anchoring means a second stringing member defining a second corner opening of the first row and a second column of openings of the pocket, attaching to each scoop hook of the plurality of scoop hooks a stringing member defining a different intermediate opening of a plurality of intermediate openings of the first row of openings between the first corner opening and the second corner opening, attaching to each of the plurality of first sidewall hooks and the plurality of first rearward cleats a stringing member defining a different opening of the first column of openings, and attaching to each of the plurality of second sidewall hooks and the plurality of second rearward cleats a stringing member defining a different opening of the second column of openings. The method may further include tensioning the pocket from the first lateral scoop hook toward a first sidewall hook of the plurality of first sidewall hooks, and from the second lateral scoop hook toward a second sidewall hook of the plurality of second sidewall hooks, so as to form a ball channel in the pocket, In an aspect, the plurality of scoop hooks may include a center scoop hook disposed on the bisecting line, and the method may further comprise tensioning the pocket from the center scoop hook toward a rearwardmost first sidewall hook positioned nearest the juncture and toward a rearwardmost second sidewall hook positioned nearest the juncture.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Embodiments provide a lacrosse head that includes attachment members (e.g., hooks or cleats) that allow for rapid, direct attachment of a pocket (e.g., mesh pocket) to the head, without requiring additional stringing members on the scoop or sidewalls (e.g., an additional scoop stringing cord or sidewall stringing cord), and without requiring stringing holes in the scoop or sidewalls. The attachment members may be integral with the remaining portions of a lacrosse head, for example, formed from the same base material in an injection molding process. The attachment members may be configured (e.g., by size and location) on the lacrosse head to pull stringing members (e.g., members of a diamond opening of a mesh pocket) of the pocket into a desired pocket shape. The attachment members may therefore provide an intuitive "plug and play" pocket stringing system for which users need minimal knowledge of stringing to install and shape a pocket. At the same time, experienced players may create pocket shapes according to their particular preferences.

Figure 1:
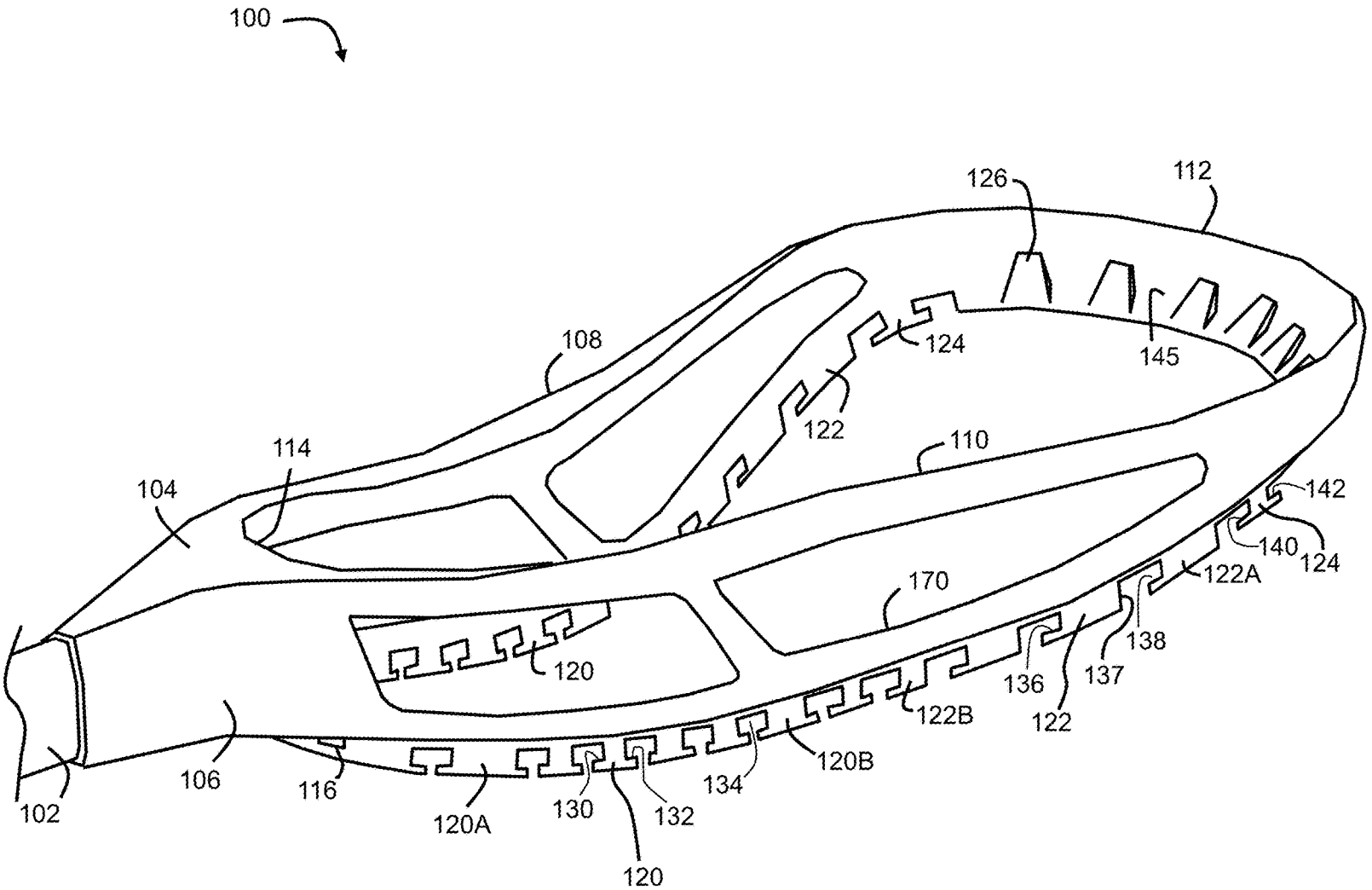
FIG. 1 is a schematic diagram of a top perspective view of a lacrosse stick having a pocket stringing system, according to an embodiment.
Figure 2:
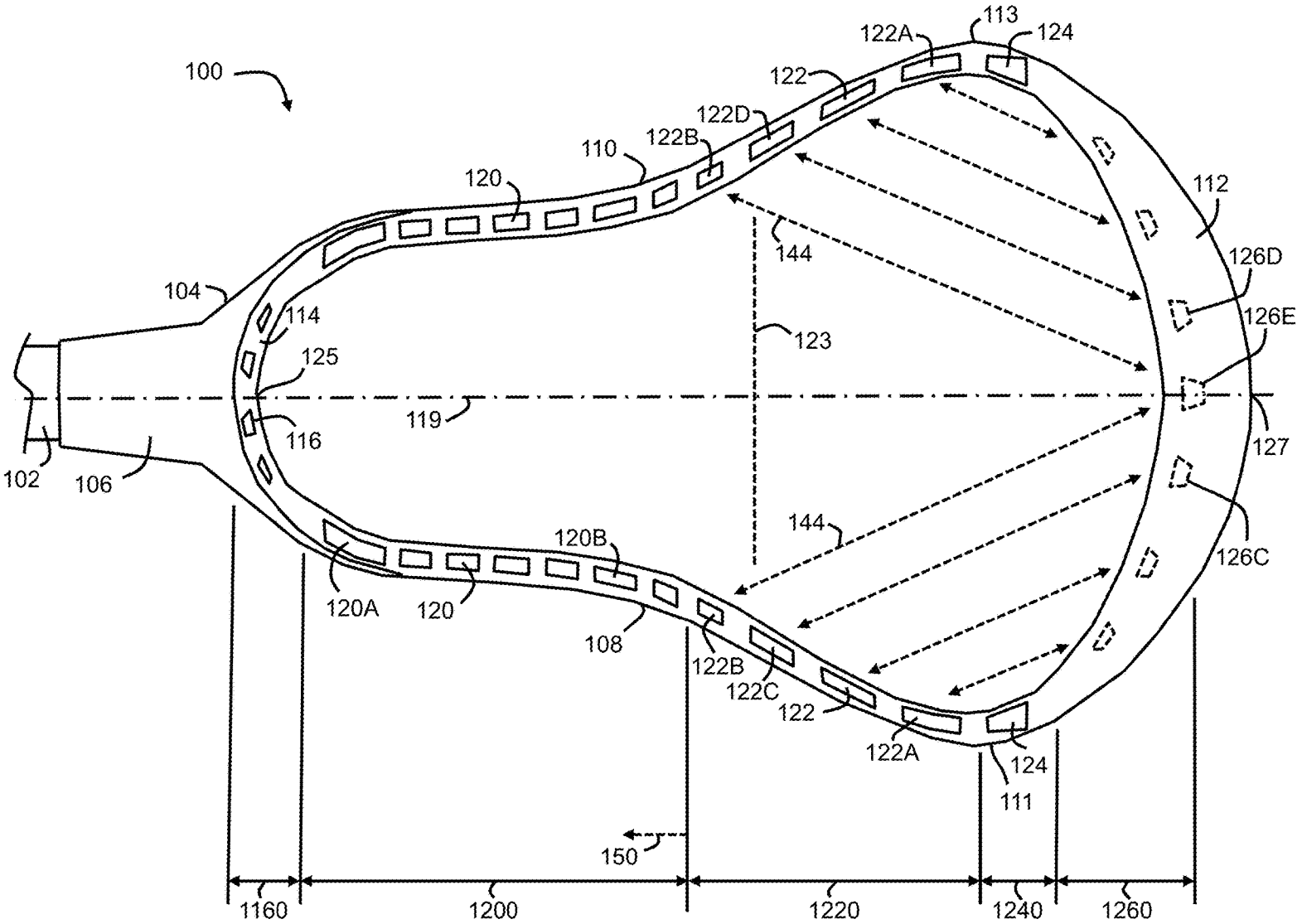
FIG. 2 is a schematic diagram of a rear view of the lacrosse stick of FIG. 1.
Figure 3:
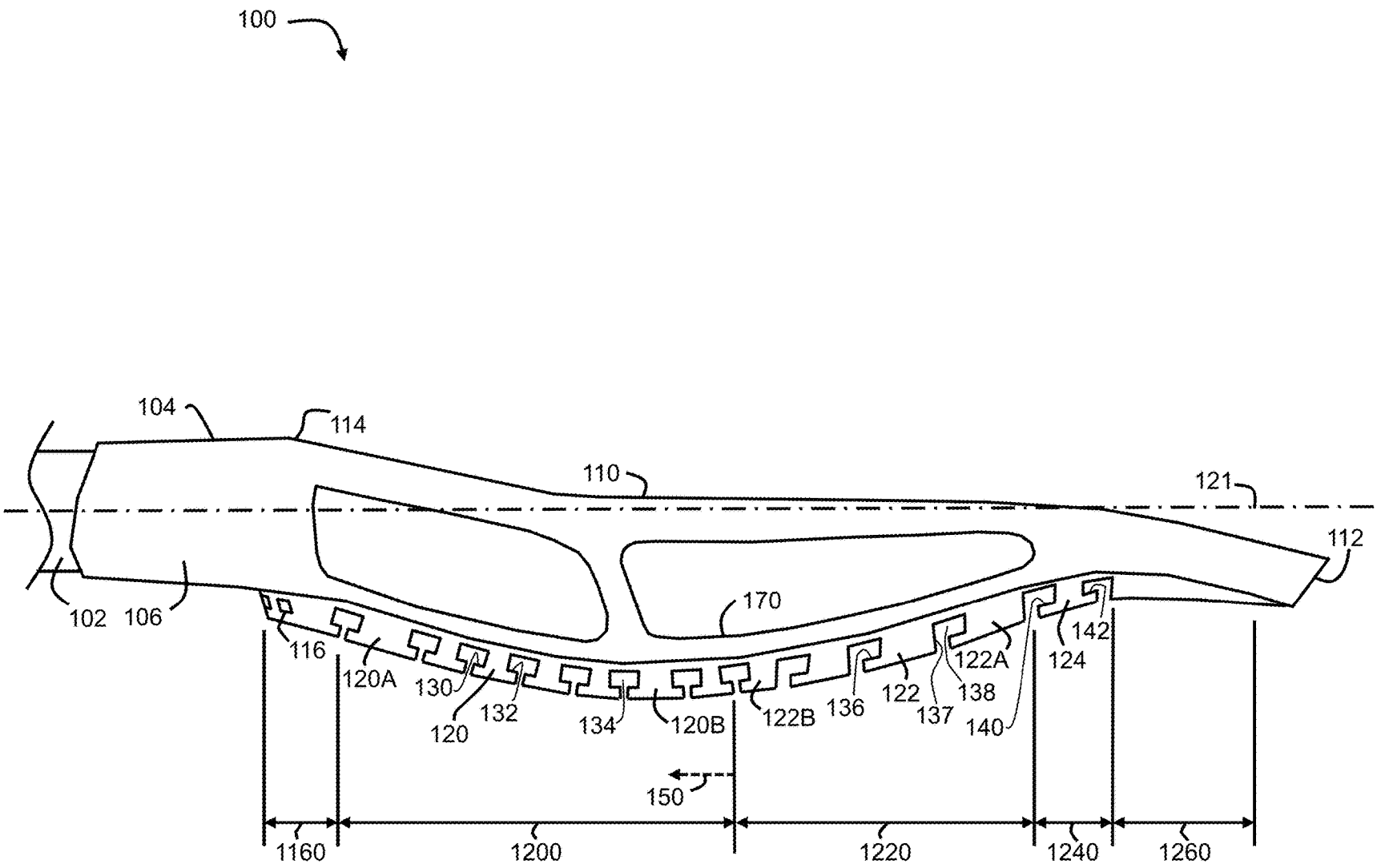
FIG. 3 is a schematic diagram of a side elevational view of the lacrosse stick of FIG. 1.

FIGS. 1-3 illustrate a representative embodiment of a lacrosse stick 100, including a handle 102 (partially shown) and a double-wall synthetic head 104. As used herein, "stick" refers to the stick as a whole, including the head and the handle. Head 104 may have a generally V-shaped frame having a juncture 106, sidewalls 108 and 110, a transverse wall (or "scoop") 112 joining the sidewalls at their ends opposite juncture 106, and a stop member (or "ball stop") 114 adjoining juncture 106 and joining sidewalls 108 and 110 at their ends nearest juncture 106. The adjoining transverse wall 112 and sidewall 108 may form a first shoulder portion 111 of the lacrosse head 104, while the adjoining transverse wall 112 and second sidewall 110 may form a second shoulder portion 113 of the lacrosse head 104. The frame may be considered to extend from a rearward end at the juncture 106 to a forward end at the transverse wall 112. As shown in FIGS. 1-3, handle 102 may fit into and through juncture 106, may abut stop member 114. The handle 102 (e.g., by a majority length of handle 102) and/or the juncture 106 (e.g., by a handle-receiving opening) may define a horizontal centerline 121 of the handle 102 and head 104 as shown, for example, in the side elevational view of FIG. 3, as well as a longitudinal bisecting line 119 as shown, for example, in the rear view of FIG. 2 (bisecting the head 104 longitudinally into two halves). Referring to FIG. 2, the frame of the lacrosse head 104 defined by the juncture 106, sidewalls 108, 110, and transverse wall 212 may define an interior pocket area, and the frame may have a rearward portion rearward of a midpoint line 123 drawn perpendicular to the bisecting line 119, and a forward portion forward of the midpoint line 123, with the midpoint line 123 located halfway between a first point 125 on the stop member along the bisecting line 119 and a second point 127 at a distal edge of the transverse wall 212 along the bisecting line 119. Screws or other fasteners may be placed through one or more openings (not shown) in juncture 106, securing handle 102 to head 104. Features of lacrosse sticks are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

Embodiments may include provisions for attaching a pocket to lacrosse head 104, including attachment members along a frame of a lacrosse head. The pocket may use a "mesh" pocket configuration, a "traditional" pocket configuration, or a combination of the two configurations. Embodiments requiring less user knowledge of stringing methods may incorporate the mesh pocket configuration into a portion of, or all of, a pocket.

A mesh pocket configuration may use a mesh knitted as a continuous piece of material. This continuous piece of material may attach to a lacrosse head as a single unit. The mesh may be attached to a lacrosse head using transverse lacing (e.g., stringing cord along the scoop or a sidewall), which may reinforce the web of the mesh that is adjacent to the lacrosse head. Embodiments may avoid the need for transverse lacing by providing means for attaching the mesh pocket directly to a lacrosse head, as described in more detail below. The mesh pocket may be made of a mesh knitted as a continuous, typically uniform design of woven material having a plurality of openings provided therein. The openings may be "mesh diamonds" or other suitable shapes, such as circles, triangles, squares, or rectangles. The mesh openings may be "uniform" because the diamonds are all of the same size and shape. In embodiments, a mesh may have an array of openings with a top row of nine openings, which may be diamond shaped. In other embodiments, a mesh may have a top row of five, six, seven, eight, or ten openings, which may be diamond shaped.

Mesh pockets may be formed from a "hard mesh," a "soft mesh," or a combination of each material. Hard mesh pockets may be stiffer and firmer than soft mesh pockets, and may be made of a combination of materials such as nylon or polyester threads coated with a stiffening material such as urethane. The stiffening material may harden the threads and prevent the threads from absorbing moisture, to avoid moisture damage to the pocket (e.g., stretching or shrinking). Forming the pocket of hard mesh, however, may make it more difficult to catch and retain the ball in the pocket. A hard mesh pocket may also require a period of break-in to form the pocket. In addition, because the harder mesh retains its shape so well, ball dislodgement may be easier.

To avoid the ball control drawbacks of hard mesh, embodiments may therefore use soft mesh, while still forming the pocket into a desired shape. Soft mesh pockets may be more pliable and forgiving than hard mesh pockets, which may enhance ball retention. Examples of materials from which soft mesh pockets may be made include nylon, polyester, and combinations thereof. Soft mesh pockets may require little, if any, break-in and may readily form a deeper, less structured pocket from which a ball is more difficult to dislodge. This less structured pocket, however, can also make it more difficult to shoot and pass. As the ball rolls from the stop member of the head toward the scoop, the soft mesh's tendency to sag may hamper the release of the ball. Embodiments may therefore include provisions for holding and tensioning a mesh pocket to form a ball channel over which balls may be thrown and caught.

Alternatively, traditional pockets may be attached to the lacrosse head 104, though installation of such traditional pocket configurations may be less convenient than mesh pocket configurations. A traditional pocket may include thongs made of leather or synthetic material strung from forward attachment means on the transverse wall 112 of the head 104 to rearward attachment means on the stop member 114. The attachment means may be, for example, hooks, openings, loops, or tabs. To complete the pocket web, crosslacing strings (e.g., nylon string) may be threaded around the thongs and attached to sidewalls 108, 110 (e.g., directly or using a stringing member), forming any number of diamonds or other shapes (crosslacing). As one embodiment, FIGS. 1-3 show four stringing openings 116 that may accept four thongs. Other numbers of thongs and thong holes may be used. In embodiments, one or more throwing or shooting strings may extend transversely between the forward portions of sidewalls 108, 110. Traditional pockets may also be pre-strung with thongs and crosslacing and then attached as a unit to a lacrosse head having attachment members as described herein.

In addition to, or in combination with, mesh and traditional pockets, other embodiments may use a pocket that is pre-formed as a unit and then attached to a lacrosse head having attachment members as described herein. For example, a pocket may be pre-shaped and made of injection-molded materials (e.g., thermoplastics), and may attach to the attachment members in a manner similar to a mesh pocket. Other pre-formed pocket materials are possible.

As exemplified in FIGS. 1-3, embodiments may include attachment members that may both secure a pocket to a lacrosse head and also form the pocket into a desired shape. As shown, the attachment members may include stringing openings 116, rearward cleats 120, sidewall hooks 122, anchoring means 124, and scoop hooks 126.

Stringing openings 116 may provide means for attaching a stringing member to the stop member 114. With a mesh pocket configuration, such a stringing member may be transverse lacing (e.g., stringing cord) strung through the stringing openings 116 and through mesh openings in the pocket. The tension on and shape of the mesh pocket may be adjusted by loosening or tightening the transverse lacing. With a traditional pocket configuration, such a stringing member may be a thong, as described above.

Rearward cleats 120 may provide means for attaching a stringing member to the sidewalls 108, 110. In embodiments, a stringing member may be a stringing member that forms a mesh opening of a mesh pocket, or a stringing member that forms a crosslace opening of a traditional pocket. As shown in FIGS. 2 and 3, rearward cleats 120 may be provided at positions forward of the stop member 114 and rearward of the sidewall hooks 122. Rearward cleats 120 may be configured to hold portions of a pocket that tend to swing in all directions and are less likely to pull significantly more in any one direction. As shown in FIGS. 1 and 3, for example, an individual rearward cleat 120 may have an inverted T-shape providing a first arm 130 and a second arm 132. The first arm 130 may be disposed on a rearward side of a base portion of the rearward cleat 120 and the second arm 132 may be disposed on a forward side of the base portion of the rearward cleat 120. The first arm 130 and second arm 132 may act as interior ledges on which portions of a stringing member may rest. The arms 130, 132 may retain the stringing member as the adjacent pocket portions swing in all directions, to avoid disengagement of the stringing member from the rearward cleat 120.

In embodiments, the quantity, locations, and sizes of the rearward cleats 120 may vary to hold pocket stringing members at particular tensions and locations to form a desired shape of the pocket, for example, positioning the deepest part of a pocket at a rearward position (low pocket), an intermediate position (mid-pocket), or a forward position (high pocket). For example, as shown in FIGS. 1-3, an embodiment providing an intermediate position may include seven rearward cleats 120 on each of sidewalls 108, 110, with the rearwardmost rearward cleat 120A having a width greater than the widths of the remaining rearward cleats, which may help curve and shape a pocket toward the stop member 114. The cleat 120B positioned at a lowest point when viewed from the side view of FIG. 3 may have a second greatest width, greater than the widths of the remaining rearward cleats except for the rearwardmost rearward cleat 120A, which may help form a lowest point of the pocket over a desired length in the rearward-to-forward direction.

Rearward cleats 120 may also be positioned relative to each other and to other attachment members and portions of the lacrosse head 104, to further secure stringing members of a pocket. For example, as shown in FIGS. 1 and 3, adjacent rearward cleats 120 may be positioned near each other, or near a sidewall hook 122 or the stop member 114, to define a keyhole opening 134. The keyhole opening 134 may provide an interior area larger than an entrance area. In other words, the interior area may have a maximum width wider than the width of the entrance area such that release of a stringing member from the interior area is restricted. A stringing member may be slipped through the smaller entrance area and into the larger interior area, where the stringing member may rest on an arm and be held from exiting the keyhole opening 134. Although the rearward cleats 120 and keyhole openings 134 in FIGS. 1-3 have rectangular shapes, other embodiments may have different shapes that provide arms and narrowed entrance areas, such as rounded rectangles and circles.

Turning to the next attachment members, sidewall hooks 122 may provide means for attaching a stringing member to the sidewalls 108, 110. In embodiments, a stringing member may be a stringing member that forms a mesh opening of a mesh pocket, or a stringing member that forms a crosslace opening of a traditional pocket. As shown in FIGS. 2 and 3, sidewall hooks 122 may be provided at positions forward of the rearward cleats 120 and rearward of the anchoring means 124 and the transverse wall 112. Sidewall hooks 122 may be configured to hold portions of a pocket that are tensioned in primarily one direction. As shown in FIGS. 1 and 3, for example, an individual sidewall hook 122 may have an L-shape providing an arm 136 extending from a base portion. The arm 136 may be disposed on a rearward side of the base portion of the sidewall hook 122, with a straight side 137 of the base portion disposed on a forward side of the sidewall hook 122. The arm 136 may act as an interior ledge on which portions of a stringing member may rest. Referring to FIG. 3, the arm 136 may retain the stringing member as the adjacent pocket portions are tensioned in a direction generally toward the transverse wall 112 and the scoop hooks 126 (to the right in FIG. 3). In other words, the stringing member is pulled securely against the inside of the L-shaped sidewall hook 122, which may avoid disengagement of the stringing member from the sidewall hook 122. Conversely, the straight side 137 may allow a stringing member to slide conveniently over the sidewall hook 122 and allow the stringing member to be pulled in the forward direction toward the transverse wall 112 and away from the sidewall hook 122.

Figure 18:
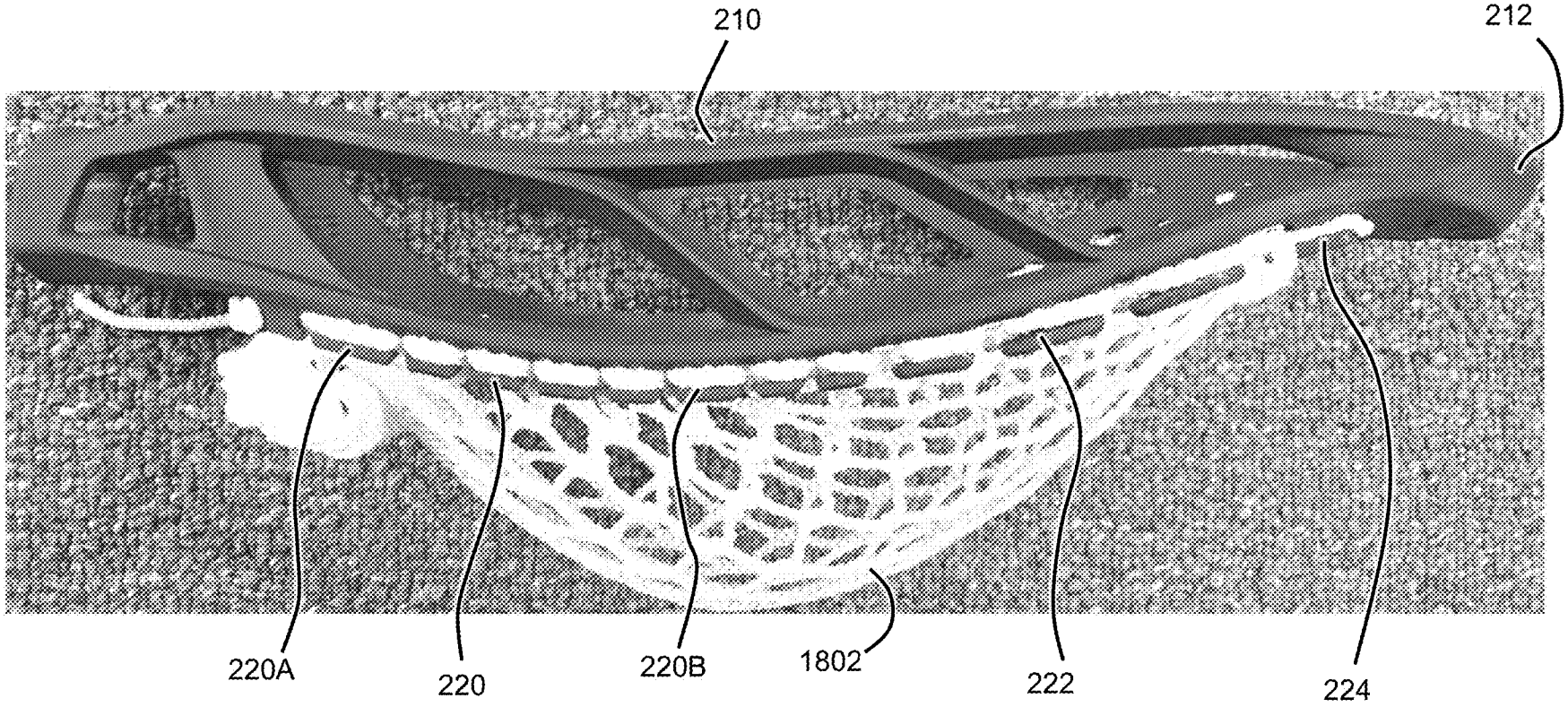
FIG. 18 is an image of a side view of a prototype of the lacrosse head of FIG. 4 with a pocket attached, according to an embodiment.

In embodiments, the quantity, locations, and sizes of the sidewall hooks 122 may vary to hold pocket stringing members at particular tensions and locations to form a desired shape of the pocket, including the placement of the deepest part of the pocket (e.g., at a rearward, intermediate, or forward position). For example, as shown in FIGS. 1-3, an embodiment may provide four sidewall hooks 122, with the forwardmost sidewall hook 122A having a width greater than the widths of the remaining sidewall hooks, which may help curve and shape a pocket toward the transverse wall 112. The sidewall hook 122B positioned at a lowest point when viewed from the side view of FIG. 3 may have a width smaller than the widths of the remaining sidewall hooks. That position and width may help form a lowest point of the pocket over a desired length in the rearward-to-forward direction, which in this case provides an intermediate pocket position (or mid-pocket), an example of which is shown in FIG. 18, discussed below.

Sidewall hooks 122 may also be positioned relative to each other and to other attachment members, to further secure stringing members of a pocket. For example, as shown in FIGS. 1 and 3, adjacent sidewall hooks 122 may be positioned near each other, or near an anchor cleat 124, to define an inverted L-shaped opening 138. The opening 138 may provide an interior area larger than an entrance area. In other words, the interior area may have a maximum width wider than the width of the entrance area such that release of a stringing member from the interior area is restricted. A stringing member may be slipped through the smaller entrance area and into the larger interior area, where the stringing member may rest on the arm 136 and be held from exiting the opening 138. Although the sidewall hooks 122 and openings 138 have rectangular shapes, other embodiments may have different shapes that provide arms and narrowed entrance areas, such as rounded rectangles and circles.

Figure 21:
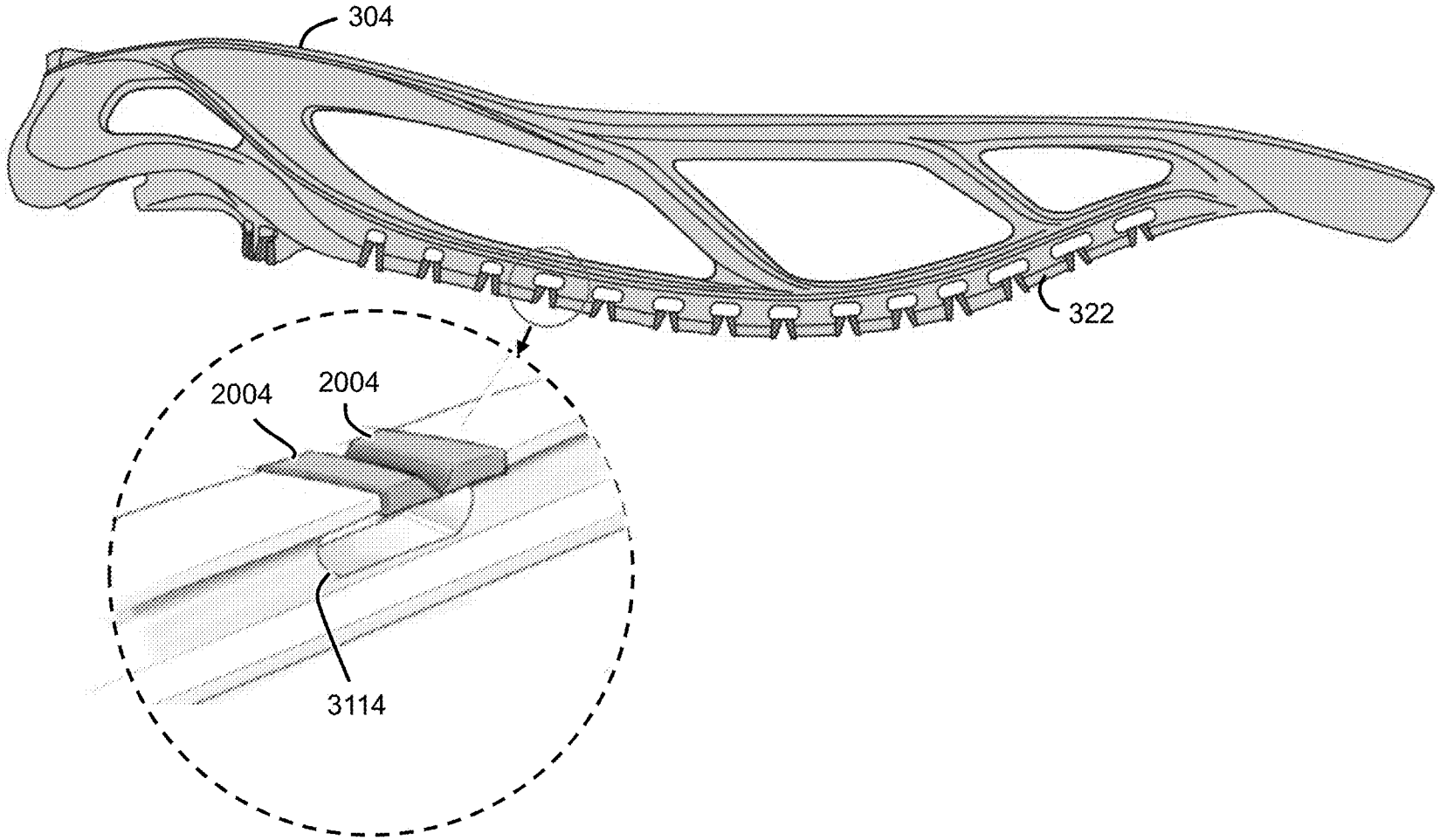
FIG. 21 is a schematic diagram of a side elevational view of a lacrosse head having attachment members with deflectable portions, along with an enlarged partial view of an attachment member, according to an embodiment.

Although sidewall cleats could be used in place of the sidewall hooks 122 of FIGS. 1-3 (see, e.g., sidewall cleats 322 of lacrosse head 304 shown in FIG. 21), the sidewall hooks may allow for more convenient attachment of a pocket. For example, because the sidewall hooks have one arm, as opposed to the two arms on a sidewall cleat, passing a mesh through an entrance area between a straight side of a first sidewall hook and an arm of a second hook may be more convenient and less likely to snag on an arm, as a stringing member of the mesh is stretched around the arm of the second hook. In embodiments, tension of a pocket may pull securely against the inside of the L-shaped sidewall hook 122 such that an additional arm on a forward side of the hook 122 is not needed for stringing member retention.

Embodiments may optionally provide means for anchoring the top corners of a pocket, such as the top left and top right openings in the top row of openings of a mesh pocket or traditional pocket. As shown in FIGS. 1-3, anchor cleats 124 may serve this function. Anchor cleats 124 may be provided at positions forward of the sidewall hooks 122 and rearward of the transverse wall 112 and scoop hooks 126. In embodiments, anchor cleats 124 may serve as starting points from which to attach a mesh, before tensioning the mesh by attaching the mesh to the sidewall hooks 122 and scoop hooks 126. Anchor cleats 124 may be configured to hold portions of a pocket that tend to be pulled in multiple directions, such as at a corner where a pocket may be pulled in the forward and rearward directions, as well as toward an interior of the pocket area. As shown in FIGS. 1 and 3, for example, an anchor cleat 124 may have an inverted T-shape providing a first arm 140 and a second arm 142. The first arm 140 may be disposed on a rearward side of the base portion of the anchor cleat 124 and the second arm 142 may be disposed on a forward side of the base portion of the anchor cleat 124. The first arm 140 and second arm 142 may act as interior ledges on which portions of a stringing member may rest. The arms 140, 142 may retain the stringing member as the adjacent pocket portions pull in multiple directions, to avoid disengagement of the stringing member from the anchor cleat 124.

Anchor cleats 124 may also be positioned relative to other attachment members and other portions of the lacrosse head 104, to further secure stringing members of a pocket. For example, as shown in FIGS. 1 and 3, an anchor cleat 124 may be positioned near a sidewall hook 122A and a portion of the sidewalls 108, 110 and/or transverse wall 112 so as to define openings, similar to the keyhole openings 134 and openings 138 described above in the context of the rearward cleats 120 and the sidewall hooks 122. The openings may provide an interior area larger than an entrance area, as described above. A stringing member may be slipped through the smaller entrance area and into the larger interior area, where the stringing member may rest on an interior ledge and be held from exiting the opening. Although the anchor cleats 124 and their associated openings in FIGS. 1-3 have rectangular shapes, other embodiments may have different shapes that provide arms and narrowed entrance areas, such as rounded rectangles and circles.

In alternative embodiments, a means for anchoring the top corners of a pocket may be an anchor hook having one arm, rather than a cleat with a forward-projecting arm and a rearward-projecting arm. For example, referring to FIGS. 1-3, anchor cleats 124 may be omitted and/or may be replaced with sidewall hooks. In some embodiments, an anchor hook may be a forwardmost sidewall hook 122 having a rearwardly-projecting arm. In other embodiments, an anchor hook may have an arm that projects in a direction opposite to the arms of the sidewall hooks 122. Referring to FIGS. 1-3, for example, an anchor cleat 142 may be replaced with a hook having a forward-projecting arm, which projects in a direction opposite to the rearward direction in which the arms 136 of sidewall hooks 122 project.

Turning to the next attachment members, as shown in FIG. 1, scoop hooks 126 may provide means for attaching a stringing member to the transverse wall (or scoop) 112. In the rear view of FIG. 2, scoop hooks 126 are shown in phantom dashed lines for illustrative purposes. In embodiments, a stringing member attached to scoop hooks 126 may be a stringing member that forms a mesh opening of a mesh pocket, or a stringing member that forms a crosslace opening or a thong of a traditional pocket. As shown in FIGS. 1-3, scoop hooks 126 may be provided at positions forward of the anchor cleats 124 and the sidewall hooks 122. Scoop hooks 126 may be configured to hold portions of a pocket that are tensioned in generally a forward-to-rearward direction. As shown in FIG. 1, for example, an individual scoop hook 126 may be an elongated member protruding in a forward direction from the upwardly-facing front face 145 of the transverse wall 112. The scoop hook 126 may define a string-retaining gap (e.g., U-shaped or V-shaped) between a downwardly-facing rear face of the scoop hook 126 and the upwardly-facing front face 145 of the transverse wall 112. Referring to FIGS. 1 and 2, the scoop hooks 126 may retain the stringing member as the adjacent pocket portions are tensioned in a direction generally in the rearward direction, with greater amounts of tension toward the anchor cleats 124 and the sidewall hooks 122 (for example, as represented by the arrows 144 in FIG. 2), and lesser amounts of tension toward the rearward cleats 120 and the stringing openings 116. In other words, a stringing member may be pulled securely against the inside of a scoop hook 126, which may avoid disengagement of the stringing member from the sidewall hook. As shown by the representative arrows 144 in FIG. 2, pocket tension may be provided between pairs of scoop hooks 126 and sidewall hooks 122.

In embodiments, the quantity, locations, and sizes of the scoop hooks 126 may vary to hold pocket stringing members at particular tensions and locations to form a desired shape of the pocket. For example, as shown in FIGS. 1-3, an embodiment may provide seven scoop hooks 126, with one scoop hook centered on the bisecting line 119, three scoop hooks disposed on one side of the center scoop hook, three scoops disposed on the opposite side of the center scoop hook, and all of the scoops spaced roughly equally apart. That configuration may help provide the tension described above in reference to arrows 144, pulling the pocket between pairs of scoop hooks and sidewall hooks, with the center scoop hook pulling against two opposing sidewall hooks. That tension may pull the pocket into a beneficial triangular shape in the forward portion of the pocket area, while forming in the pocket along the bisecting line a ball channel that narrows in the rearward-to-forward direction.

Although the scoop hooks 126 have trapezoidal shapes, other embodiments may have different shapes that provide string-retaining gaps, such as rounded trapezoids, triangles, rectangles, squares, circles, or ovals.

As seen in FIGS. 1-3, a system of attachment members may allow stringing members to slide or otherwise move around the attachment members, rather than being fixed at an attachment point (e.g., held in place by a hook-and-loop fastener). Such movement may provide the desired tensions and pocket configurations, and may also allow movement of the pocket stringing members during play to, for example, provide a more flexible pocket and to avoid stress and wear on individual stringing members of the pocket.

In embodiments, a system of attachment members, such as those of the embodiments of FIGS. 1-3, may facilitate a method of rapidly stringing a lacrosse head. The attachment members may allow a user to directly attach a pocket to the head, without requiring additional, complicating stringing members on the scoop or sidewalls. In embodiments, a pocket may be attached by conveniently placing stringing members of the pocket around attachment members of the sidewalls and transverse wall of the lacrosse head, without tying any stringing members. A pocket may also be rapidly removed from the sidewalls and transverse wall of a head without untying or cutting any stringing members. Different pockets (e.g., soft mesh, hard mesh, and traditional) may be quickly and conveniently interchanged on a lacrosse head to accommodate and adapt to different playing styles and conditions.

In embodiments, a method for rapid lacrosse head pocket stringing may begin with a preformed pocket having an array of openings, such as a mesh pocket or a pre-strung unitary traditional pocket. The array of openings in the pocket may be arranged in rows and columns. For example, a mesh pocket may have a top row of nine diamond shaped openings, with a first corner opening in that top row, a second opposite corner in that top row, and seven intermediate openings in between the first and second corner openings in that top row.

Referring to FIGS. 1-3, the method for rapid stringing may continue by attaching the first corner opening of the mesh pocket to a first anchoring means, such as one of anchor cleats 124. The method may then continue by attaching the second corner opening of the mesh pocket to a second anchoring means, such as the other anchor cleat 124 in FIGS. 1-3. Then, the seven intermediate openings in the top row of openings of the pocket may be attached to the seven scoop hooks 126.

In embodiments, attaching an intermediate opening that is adjacent to a corner opening may involve routing a stringing member of the pocket from underneath a sidewall to above the scoop, when viewing the head from a side view. For example, in FIGS. 1-3, because the anchor cleats 124 project downwardly and the scoop hooks 126 project upwardly, an embodiment of a rapid stringing method may route a stringing member of the intermediate opening adjacent to the corner opening, from under sidewall 108 to above transverse wall 112 and around a scoop hook 126 nearest the anchor cleat 124. In embodiments, a method may route the stringing member through a passageway defined by the lacrosse head between the anchor cleat 124 and the scoop hook 126, embodiments of which are described below.

The method for rapid stringing may then continue by attaching openings below the top row of openings to the lacrosse head attachment members. For example, referring to FIGS. 1-3, in a first column of openings below the first corner opening, the first four openings may be attached to the sidewall hooks 122 of the first sidewall 108, and the next seven openings may be attached to the sidewall cleats 120 of the first sidewall 108. Likewise, in a second column of openings below the second corner opening, the first four openings may be attached to the sidewall hooks 122 of the second sidewall 110, and the next seven openings may be attached to the sidewall cleats 120 of the second sidewall 110.

Based on the configuration of the attachment members, securing the pocket to the lacrosse head in this manner may tension the pocket from a scoop hook toward a sidewall hook as described above in reference to arrows 144. For example, referring to FIG. 2, the method may tension the pocket from a first lateral scoop hook 126C disposed on a first side of the bisecting line 119 nearest the first sidewall 108 toward a first sidewall hook 122C, and from a second lateral scoop hook 126D disposed on second side of the bisecting line 119 nearest the second sidewall 110 toward a second sidewall hook 122D. In embodiments having a center scoop hook 126E disposed on the bisecting line 119, as is the case with the embodiments of FIGS. 1-3, the method may also tension the pocket from the center scoop hook 126E toward a rearwardmost first sidewall hook 122B positioned nearest the juncture 106 and toward a rearwardmost second sidewall hook 122B positioned nearest the juncture 106. As described above, this method of rapid stringing may tension the pocket such that a desired ball channel is formed in the pocket.

The method may then continue by attaching a rearward portion of the pocket to attachment members of the stop member 114. For example, four openings in a row of openings below the row of openings at which the rearwardmost rearward cleats 120A are positioned, may be attached to stringing openings 116 using a stringing cord. Alternatively, stop member 114 may have hooks or cleats to which the four openings may be directly attached.

Based on the above different types of attachment members and rapid stringing methods, embodiments may provide desired pocket shapes, such as a cup-shaped rearward ball-retaining portion that enhances ball control and retention within a lacrosse head, and a ball channel that narrows in the rearward-to-forward direction and facilitates accurate passing, shooting, and catching. In embodiments, the different types of attachment members may be applied to a lacrosse head in zones, to tension the pocket stringing members in directions that create desired shapes. FIGS. 2 and 3 illustrate an example of such zones. Moving in a rearward-to-forward direction, the zones may be positioned sequentially starting with stop member stringing zone 1160, then rearward cleat zone 1200, then sidewall hook zone 1220, then anchor cleat zone 1240, and finally, scoop hook zone 1260. Each zone may include a number of its corresponding attachment member type appropriate for securing the particular pocket (e.g., corresponding to the number of openings). The stop member stringing zone 1160 may secure a rearwardmost portion of the pocket and pull generally in the rearward direction against the scoop hook zone 1260. The rearward cleat zone 1200 may secure a rearward portion of the pocket and allow that portion to hang loosely in a rounded shape and to swing freely. The sidewall hook zone 1220 may secure a middle and/or forward portion of the pocket, pulling that portion of the pocket upward from the bottom of the rounded rearward ball-retaining pocket portion to decrease the depth of the pocket, and pulling tighter against the scoop hook zone 1260 to form a ball channel in the pocket, as represented by the arrows 144 in FIG. 2, which narrows in the rearward-to-forward direction from the rearward side of the sidewall hook zone 1220 to the scoop hook zone 1220. The anchor cleat zone 1240 may hold the top corner portions of the pocket. The scoop hook zone 1260 may secure a forwardmost portion of the pocket, pulling that portion of the pocket upward from the ball-retaining pocket portion formed at the rearward cleat zone 1200 and generally against the stop member stringing zone 1160, and pulling tighter against the sidewall hook zone 1220, as represented by the arrows 144 in FIG. 2.

In embodiments, the quantities, sizes, and locations of individual attachment members within the zones may vary to provide desired pocket shapes, as described above. In embodiments, to provide a tension on the pocket that forms a desired ball channel, the number of sidewall hooks on each sidewall may be equal, and the quantity of scoop hooks may be equal to the total quantity of sidewall hooks minus one, with a center scoop hook (e.g., disposed on bisecting line 119) providing tension between itself and the rearwardmost sidewall hook on each sidewall. For example, referring to FIG. 2, lacrosse head 104 may have four sidewall hooks 122 on each sidewall 108, 110, for a total of eight sidewall hooks 122, and may have seven scoop hooks 126 ((8 sidewall hooks)−1=7 scoop hooks), with the scoop hook 126 on the bisecting line 119 providing tension between itself and sidewall hooks 122B.

In alternative embodiments, a center scoop hook 126 on the bisecting line 119 may be omitted, and the scoop hooks 126 laterally offset with respect to the bisecting line may provide adequate tension to form a desired pocket shape.

In addition, the lengths of the zones in the rearward-to-forward direction may vary to provide desired pocket shapes. For example, referring to FIGS. 2 and 3, to provide a longer, narrower ball channel and a shorter ball-retaining portion, embodiments may shorten the rearward cleat zone 1200 and lengthen the sidewall hook zone 1220 (as represented by dashed arrows 150), so that the tension between the scoop hook zone 1260 and the sidewall hook zone 1220 extends farther in the rearward direction. In other words, that configuration may provide directions of tension, as represented by arrows 144, that are at smaller angles relative to the bisecting line 119, which may lengthen and narrow the ball channel.

In additional embodiments, the lengths of the zones may be adjusted to, for example, move pocket locations forward or rearward, change the length and/or width of the ball channel, or change the length and/or location of the ball-retaining portion. Such adjustments may accommodate different play characteristics.

Incorporating aspects described above in reference to FIGS. 1-3, an embodiment provides a lacrosse stick 200 having attachment members that allow for direct attachment of a pocket to the lacrosse head, without requiring additional stringing members on the scoop or sidewalls, as shown in FIGS. 4-16. Lacrosse stick 200 may include a handle 202 (partially shown in FIGS. 5-8) and a double-wall synthetic head 204. Head 204 may have a generally V-shaped frame having a juncture 206, sidewalls 208 and 210, a transverse wall 212 joining the sidewalls 208 and 210 at their ends opposite juncture 206, and a stop member 214 adjoining juncture 206 and joining sidewalls 208 and 210 at their ends nearest juncture 206. The frame may be considered to extend from a rearward end at the juncture 206 to a forward end at the transverse wall 212. As shown in FIGS. 5-8, handle 202 may fit into and through juncture 206, may abut stop member 214, and may define (by a majority length of handle 202) a horizontal centerline 221 of the handle 202 and head 204 as shown, for example, in the side elevation views of FIGS. 7 and 8, as well as a longitudinal bisecting line 219 as shown, for example, in the front view of FIG. 5 and rear view of FIG. 6 (bisecting the head 204 longitudinally into two halves). Screws or other fasteners may be placed through openings 207 in juncture 206, securing handle 202 to head 204.

In embodiments, lacrosse stick 200 may include many of the same features of the embodiments of FIGS. 1-3 described above, which are apparent from the figures and are indicated by like reference numerals (e.g., the digits after the first digit). For brevity, some of the features may not be repeated; however, all of the above-described features and associated benefits should be considered applicable to embodiments of FIGS. 4-16 as appropriate. In addition, embodiments of FIGS. 4-16 may provide additional aspects of a lacrosse head that facilitate direct attachment of a pocket.

As exemplified in FIGS. 4-16, embodiments may include attachment members that may both secure a pocket to a lacrosse head and also form the pocket into a desired shape. As shown, the attachment members may include stringing openings 216, rearward cleats 220, sidewall hooks 222, anchor cleats 224, and scoop hooks 226.

Stringing openings 216 may provide means for attaching a stringing member to the stop member 214, which as described above may be transverse lacing for a mesh pocket configuration, or a thong for a traditional pocket configuration. The transverse lacing may be used to adjust the tension, shape, depth, and/or position of a pocket.

Figure 17:
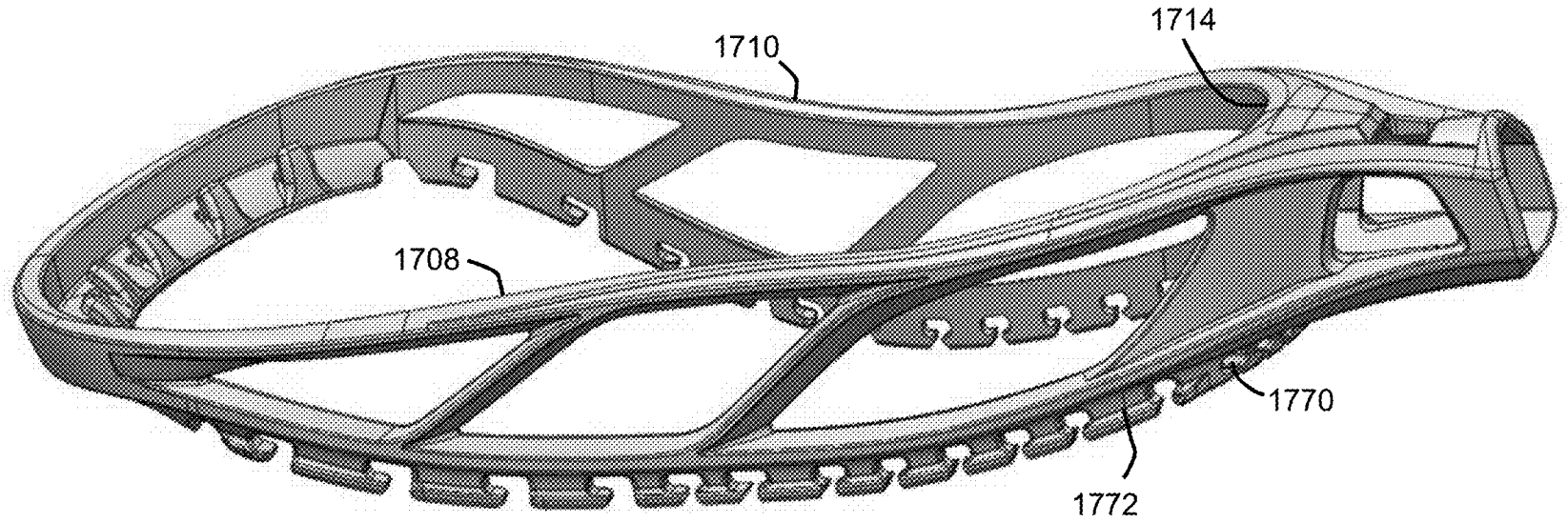
FIG. 17 is a schematic diagram of a perspective view of another embodiment of a lacrosse head having a pocket stringing system.

Other embodiments may provide different types of attachment members in the stop member. For example, as shown in FIG. 17, one embodiment may provide cleats 1770 in the stop member 1714 such that cleats run from a rearward portion of the first sidewall 1708, through the stop member 1714, and to a rearward portion of the second sidewall 1710. In addition, with cleat attachment members running along these zones of the lacrosse frame, embodiments may provide anchor cleats 1772 at the areas between the first sidewall 1708 and the stop member 1714 and between the stop member 1714 and the second sidewall 1710. Anchor cleats 1772 may be wider than the remaining cleats so as to provide anchor points for the corners of the rearward portion of a pocket, for better securement of the pocket.

Referring again to FIGS. 4-16, rearward cleats 220 may provide means for attaching to the sidewalls 208, 210 a stringing member, such as a stringing member of a mesh opening of a mesh pocket or a crosslace opening of a traditional pocket. As shown in FIGS. 4 and 6-12, rearward cleats 220 may be provided at positions forward of the stop member 214 and rearward of the sidewall hooks 222. Rearward cleats 220 may be configured to hold portions of a pocket that tend to swing in all directions and are less likely to pull significantly more in any one direction. As shown, for example, an individual rearward cleat 220 may have an inverted T-shape providing a first arm 230 and a second arm 232. The first arm 230 may be disposed on a rearward side of the base portion of the rearward cleat 220 and the second arm 232 may be disposed on a forward side of the base portion of the rearward cleat 220. The first arm 230 and second arm 232 may act as interior ledges on which portions of a stringing member may rest. The arms 230, 232 may retain the stringing member as the adjacent pocket portions swing in all directions, to avoid disengagement of the stringing member from the rearward cleat 220.

In embodiments, the quantity, locations, and sizes of the rearward cleats 220 may vary to hold pocket stringing members at particular tensions and locations to form a desired shape of the pocket. For example, as shown in FIGS. 4-10, an embodiment may provide seven rearward cleats 220 on each of sidewalls 208, 210, with the rearwardmost rearward cleat 220A having a width greater than the widths of the remaining rearward cleats, which may help curve and shape a pocket toward the stop member 214. The cleat 220B positioned at a lowest point when viewed from the side view of FIG. 7 may have a second greatest width, greater than the widths of the remaining rearward cleats except for the rearwardmost rearward cleat 220B, which may help form a lowest point of the pocket over a desired length in the rearward-to-forward direction.

Rearward cleats 220 may also be positioned relative to each other and to other attachment members and portions of the lacrosse head 200, to further secure stringing members of a pocket. For example, as shown in FIGS. 4, 7, 8, 11, and 12, adjacent rearward cleats 220 may be positioned near each other, or near a sidewall hook 222 or the stop member 214, to define a keyhole opening 234. The keyhole opening 234 may provide an interior area larger than an entrance area. In other words, the interior area may have a maximum width wider than the width of the entrance area such that release of a stringing member from the interior area is restricted. A stringing member may be slipped through the smaller entrance area and into the larger interior area, where the stringing member may rest on an interior ledge and be held from exiting the keyhole opening 234. Although the rearward cleats 220 and keyhole openings 234 in FIGS. 4 and 7-12 have rounded polygonal shapes, other embodiments may have different shapes that provide arms and narrowed entrance areas.

Figure 11:
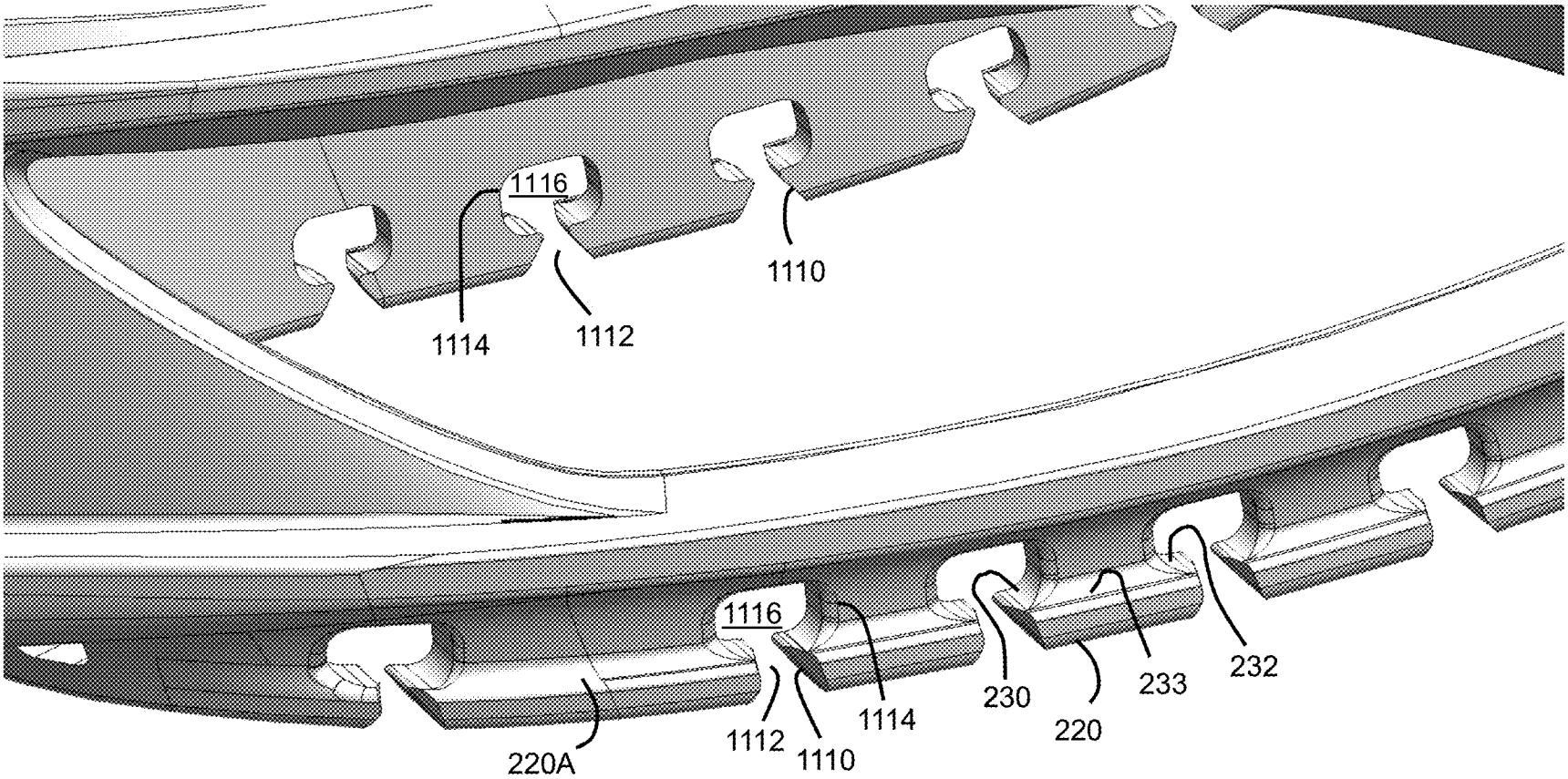
FIGS. 11-13 are schematic diagrams of enlarged partial views of the sidewalls of the lacrosse head of FIG. 4, according to an embodiment.
Figure 12:
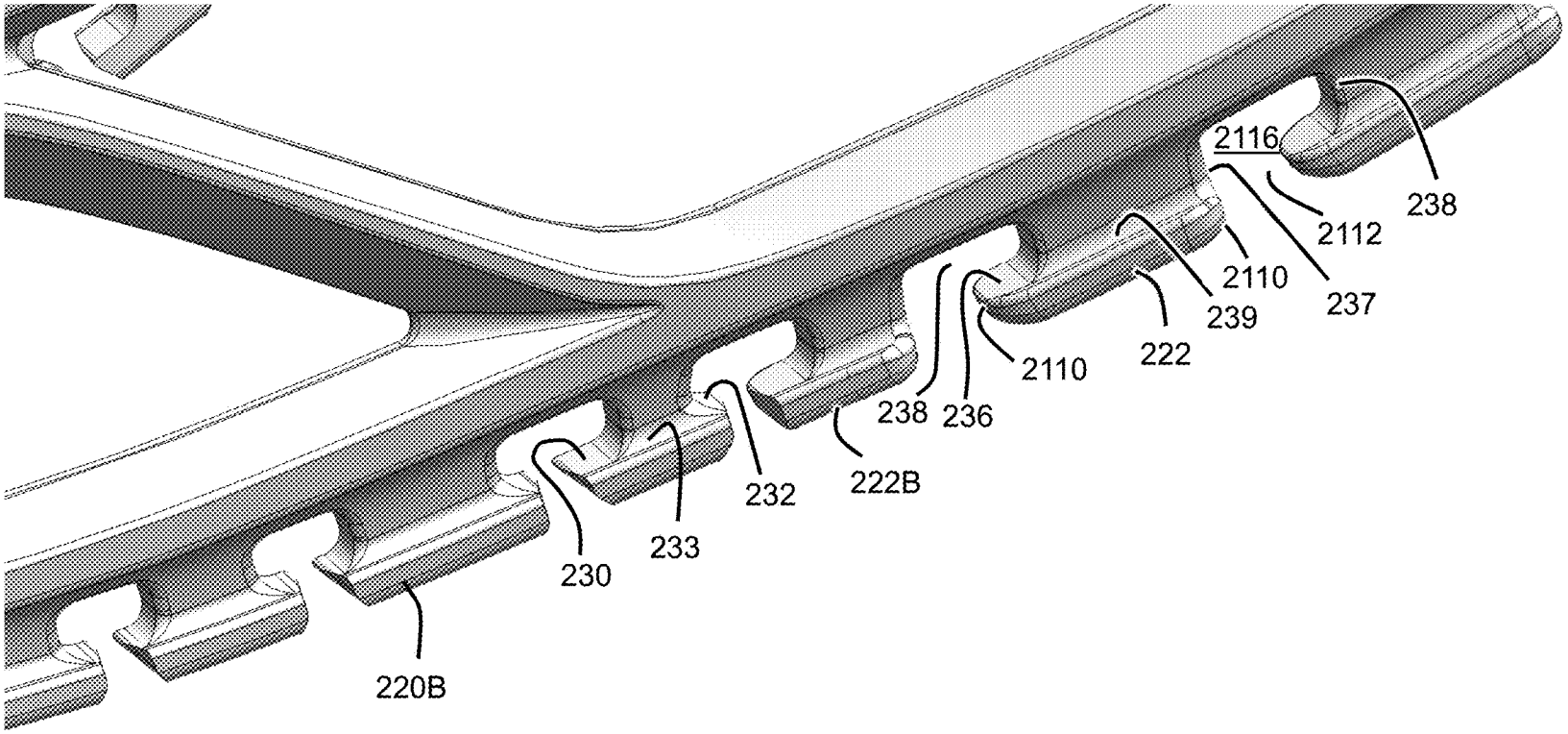
Figure 19:
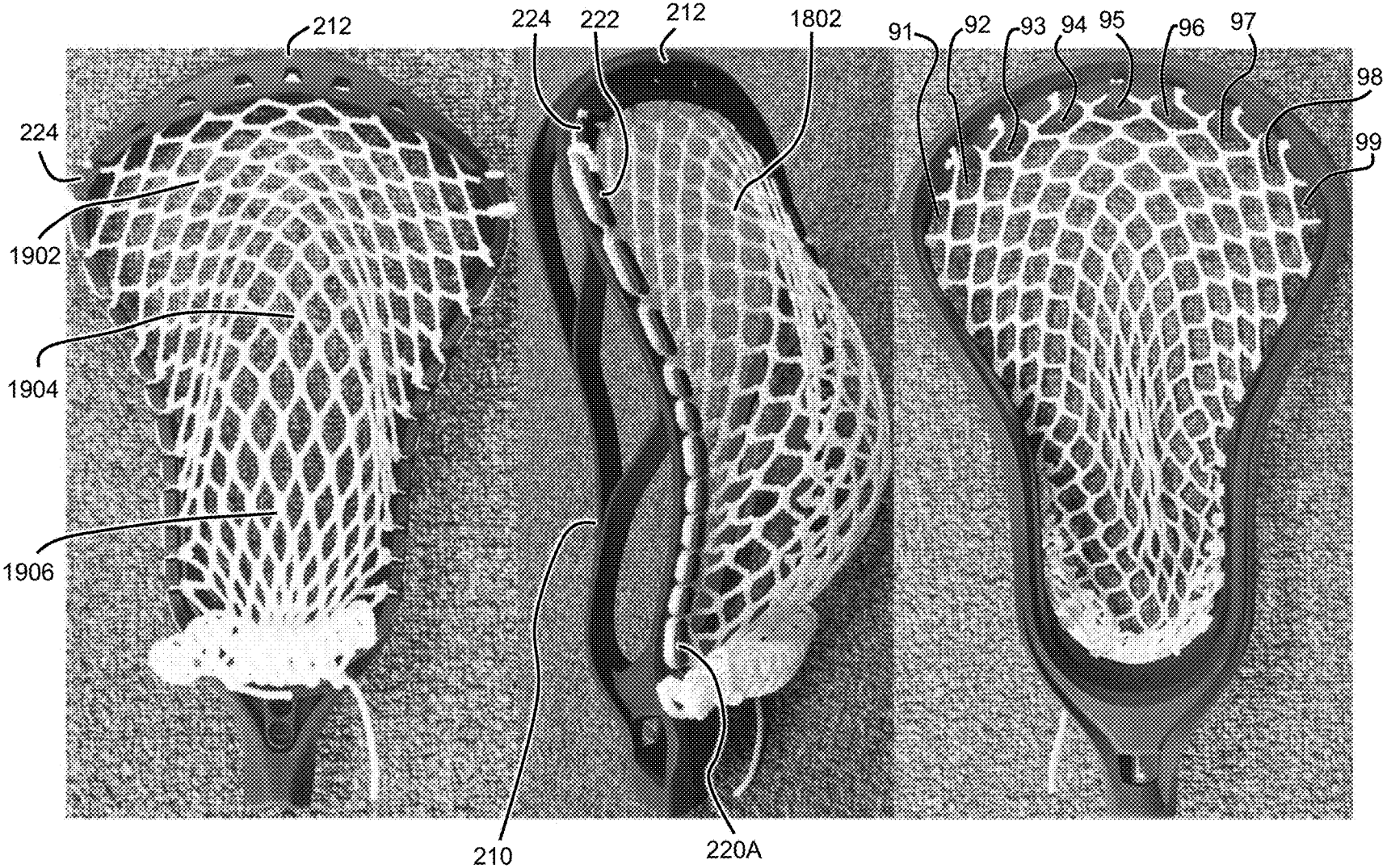
FIG. 19 is a set of images of, from left to right, a rear, perspective, and front view of the prototype of FIG. 18, according to an embodiment.
Figure 20:
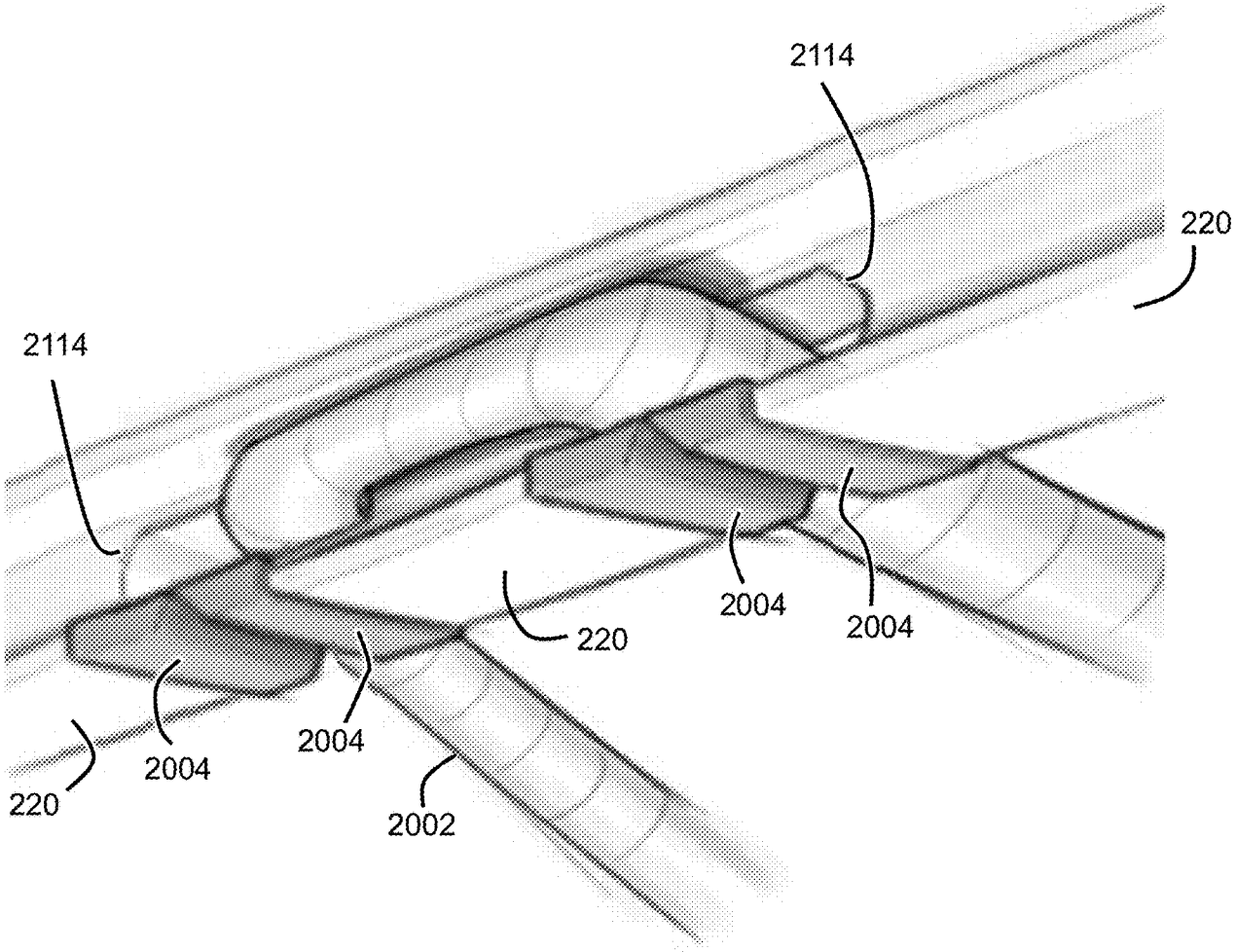
FIG. 20 is a schematic diagram of an enlarged partial perspective view of a sidewall having a cleat, with a stringing member attached, according to an embodiment.

As shown best in FIGS. 11 and 12, a rearward cleat 220 may also include an outer ledge 233 on a side of the rearward cleat 220 opposite to the interior of the lacrosse head. This configuration may allow a pocket stringing member to be routed around the rearward cleat 220, resting on the arms 230, 232 and ledge 233. Examples of such pocket stringing member routing are shown in the embodiments of FIGS. 18-20. FIGS. 18 and 19 illustrate stringing members of a pocket 1802 routed around, and resting upon, arms and ledges of rearward cleats 220. FIG. 20 illustrates an enlarged partial view of a lower edge of a sidewall having a cleat 220, with a stringing member 2002 routed through keyhole openings 2114, and routed around, and resting upon, the arms and ledge of the rearward cleat 220.

As shown best in FIGS. 11 and 12, rearward cleats 220 may also include additional provisions for facilitating convenient stringing of a pocket. In embodiments, referring to the orientation of FIGS. 11 and 12, the lower corners 1110 of an inverted T-shape rearward cleat 220 may be angled outwardly from the base portion of the cleat 220 moving in an upward direction toward the interior area 1116 of a keyhole opening 1114. With this configuration, two adjacent rearward cleats 220 may define an entrance area 1112 of a keyhole opening 1114 that narrows in a direction toward the interior area 1116. For example, an entrance area 1112 may be wedge-shaped or funnel-shaped. That configuration may allow a user to more conveniently place a stringing member through the wider outer opening of the entrance area 1112, then through the narrower inner opening of the entrance area 1112, and into the interior area 1116, where the stringing member may be retained due to the arms 230, 232.

To further facilitate convenient stringing and retain stringing members, embodiments may also provide a deflectable portion on a cleat, which may deflect to allow passage of a stringing member, and after the stringing member passes through, may return to its original configuration. The deflectable portion may be provided near an entrance area to an opening, which may be a keyhole opening or another shaped opening, such as a circular or oval opening. Referring to FIGS. 11 and 12, a deflectable portion may be provided at the lower corners 1110 of the inverted T-shape rearward cleats 220. The deflectable portion may be a mechanical feature, such as a living hinge, or a material feature, such as an overmolded material (e.g., thermoplastic elastomer) more flexible than the base material of a lacrosse head frame.

As an example, FIG. 20 illustrates one embodiment of overmolded deflectable portions 2004 formed on rearward cleats 220. Adjacent deflectable portions 2004 may define a wedge-shaped gap through which stringing member 2002 may pass. The stringing member 2002 may bend the deflectable portions 2004 toward the opening 1114 as the stringing member 2002 passes through the gap, after which the deflectable portions 2004 may return to their original positions. The deflectable portions 2004 may also bend in the opposite direction, away from opening 2114, to allow the stringing member 2002 to exit opening 2114. Bending the deflectable portions 2004 in the opposite direction away from opening 2114 may require more force, to better retain the stringing member 2002 in the openings 2114.

As a further example, FIG. 21 illustrates deflectable portions 2004 applied to openings 3114 along the length of a lacrosse head 304. Each opening 3114 may have a narrow entrance area defined by the deflectable portions 2004. Each opening 3114 may house a stringing member of a pocket and the deflectable portions 2004 may lock the stringing member in place.

Figure 4:
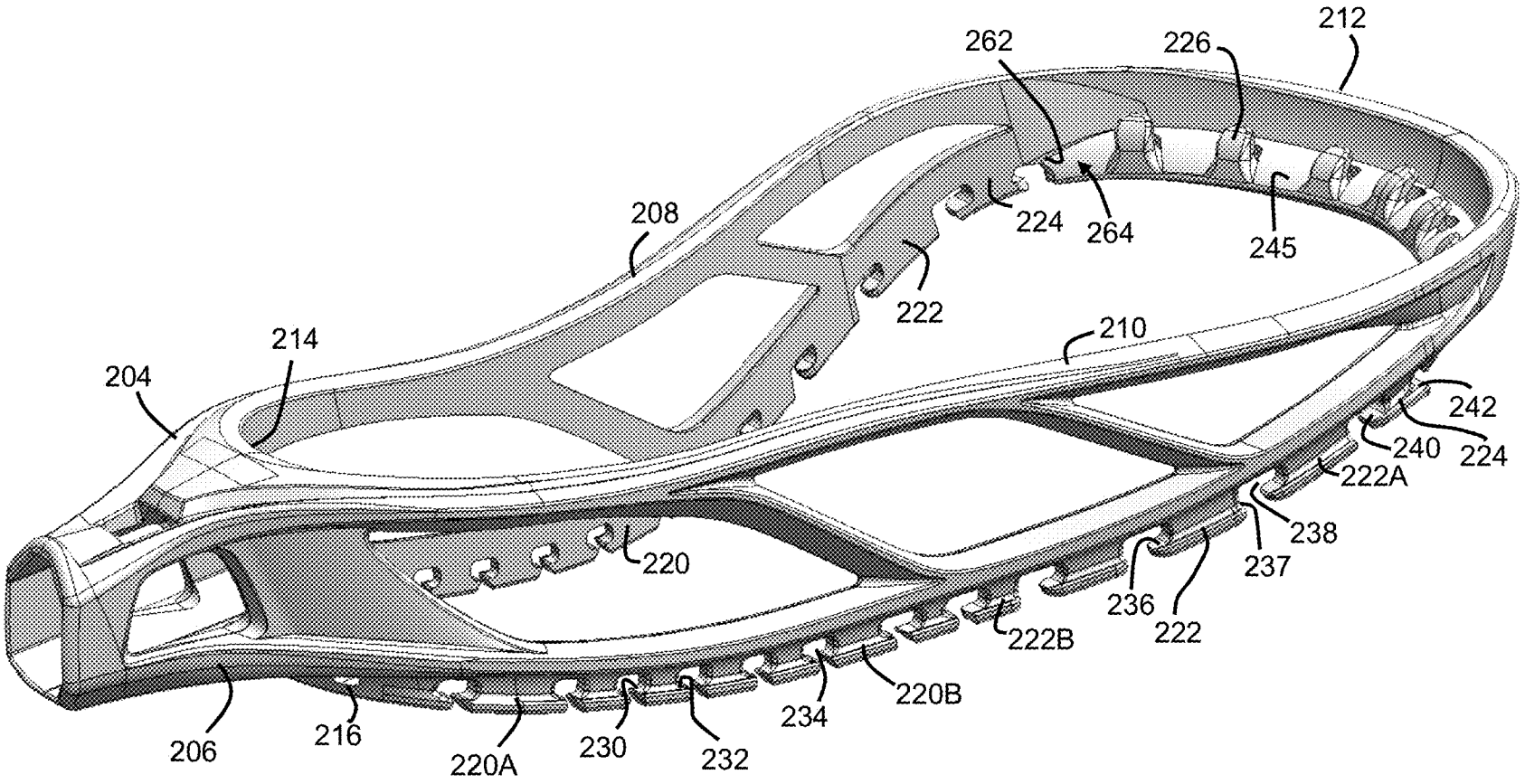
FIG. 4 is a schematic diagram of a perspective view of a lacrosse head having a pocket stringing system, according to another embodiment.
Figure 7:
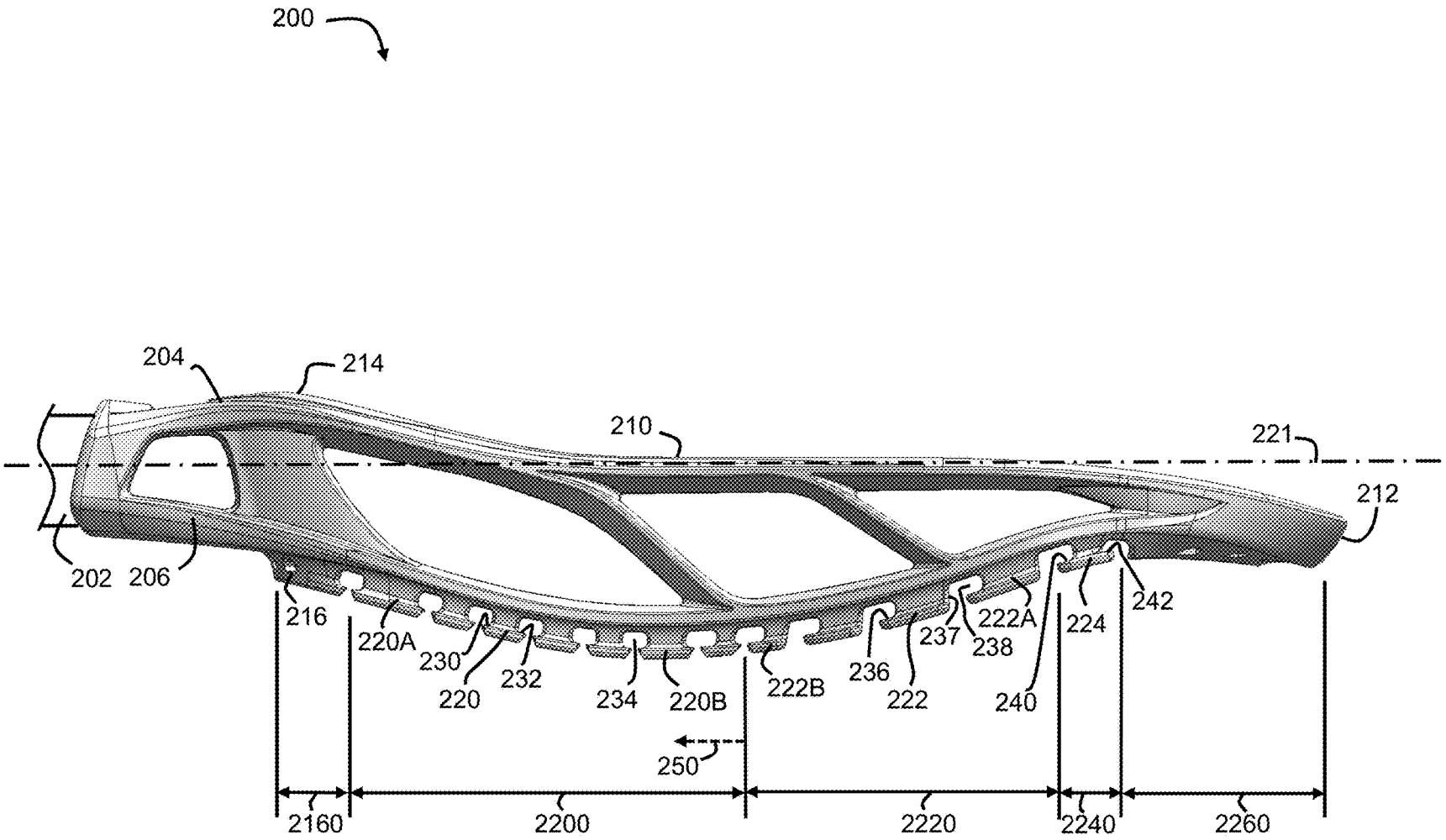
FIG. 7 is a schematic diagram of a side elevational view of the lacrosse stick of FIG. 5.
Figure 8:
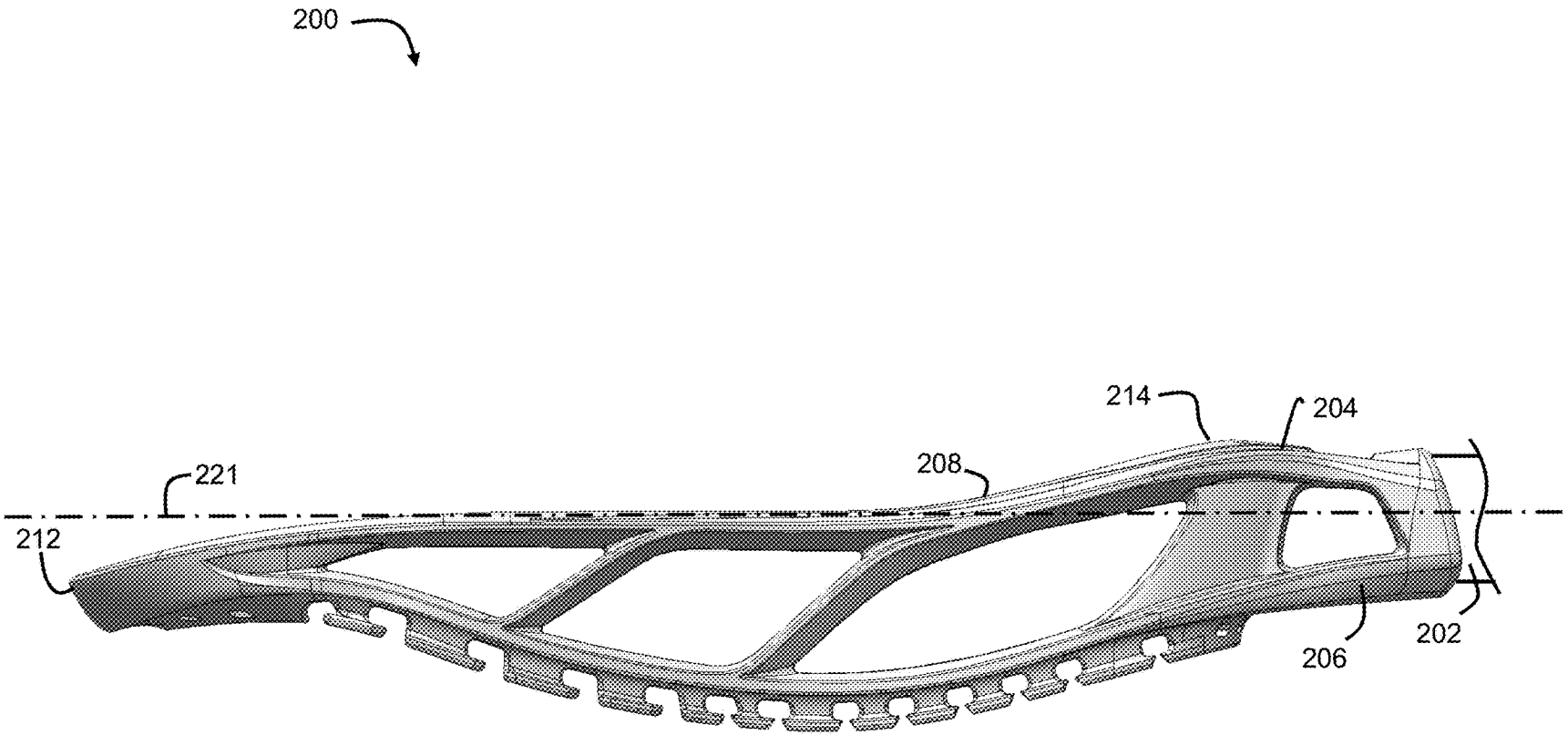
FIG. 8 is a schematic diagram of an opposite side elevational view of the lacrosse stick of FIG. 5.
Figure 9:
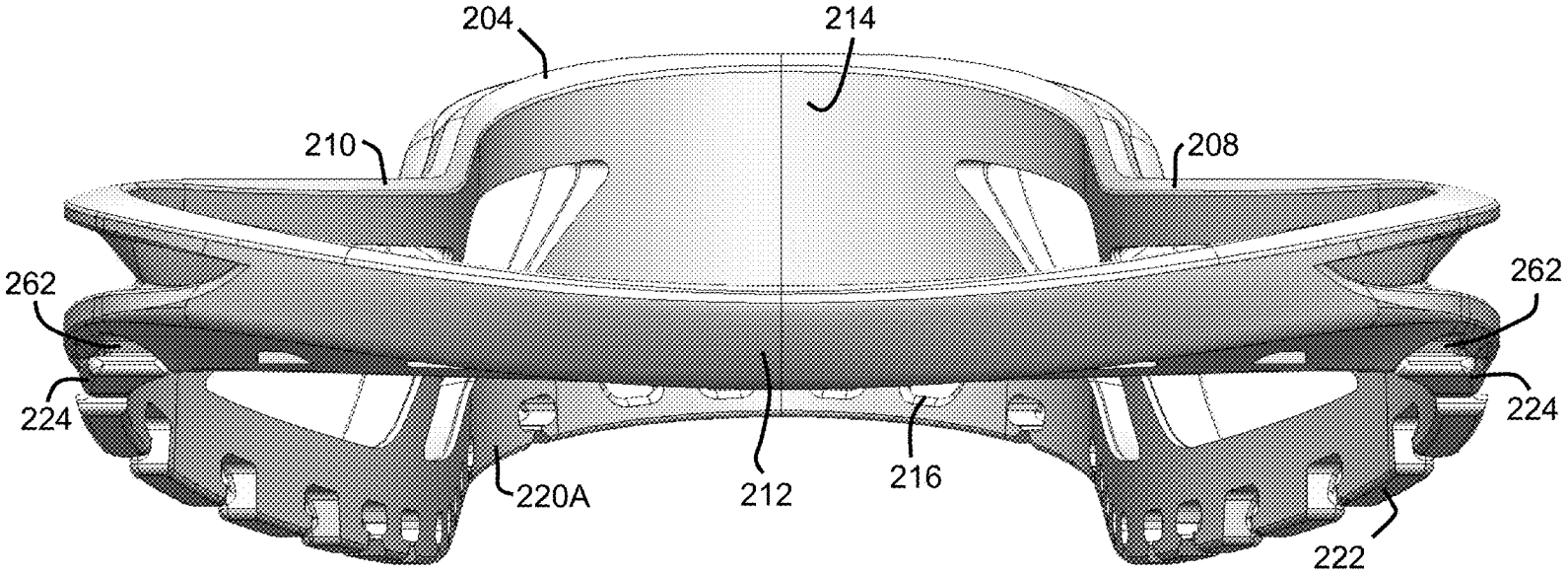
FIG. 9 is a schematic diagram of a top view of the lacrosse head of FIG. 4, according to an embodiment.
Figure 10:
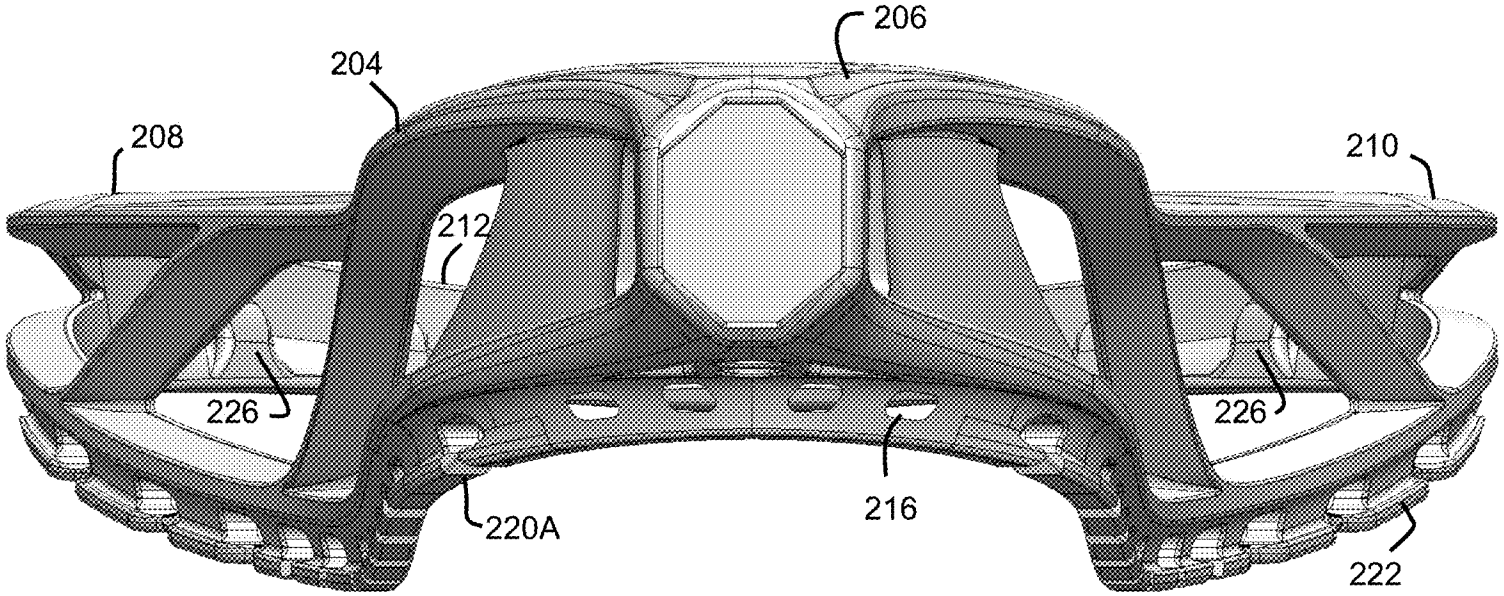
FIG. 10 is a schematic diagram of a bottom view of the lacrosse head of FIG. 4, according to an embodiment.

Referring again to FIGS. 4-16, sidewall hooks 222 may provide means for attaching to the sidewalls 208, 210 a stringing member, such as a stringing member of a mesh opening of a mesh pocket or a crosslace opening of a traditional pocket. As shown in FIGS. 4 and 6-8, sidewall hooks 222 may be provided at positions forward of the rearward cleats 220 and rearward of the anchor cleats 224 and the transverse wall 212. Sidewall hooks 222 may be configured to hold portions of a pocket that are tensioned in primarily one direction. As shown in FIGS. 4, 7, and 8, for example, an individual sidewall hook 222 may have an L-shape providing an arm 236 extending from a base portion. The arm 236 may be disposed on a rearward side of the base portion of the sidewall hook 222, with a straight side 237 of the base portion disposed on a forward side of the sidewall hook 222. The arm 230 may act as an interior ledge on which portions of a stringing member may rest. Referring to FIG. 7, the arm 236 may retain the stringing member as the adjacent pocket portions are tensioned in a direction generally toward the transverse wall 212 and the scoop hooks 226 (to the right in FIG. 3). In other words, the stringing member is pulled securely against the inside of the L-shaped sidewall hook 222, which may avoid disengagement of the stringing member from the sidewall hook 222.

In embodiments, the quantity, locations, and sizes of the sidewall hooks 222 may vary to hold pocket stringing members at particular tensions and locations to form a desired shape of the pocket. For example, as shown in FIGS. 4 and 6-8, an embodiment may provide four sidewall hooks 222, with the forwardmost sidewall hook 222A having a width greater than the widths of the remaining sidewall hooks, which may help curve and shape a pocket toward the transverse wall 212. The sidewall hook 222B positioned at a lowest point when viewed from the side view of FIG. 7 may have a width smaller than the widths of the remaining sidewall hooks, which may help form a lowest point of the pocket over a desired length in the rearward-to-forward direction. In embodiments, moving in a rearward-to-forward direction, each sidewall hook 222 may have a width narrower than a next adjacent sidewall hook 222, which may provide tension on stringing members of the pocket that forms the pocket into a desired shape and a desired position, which in this case is an intermediate pocket position (or mid-pocket), an example of which is shown in FIG. 18, discussed below.

Sidewall hooks 222 may also be positioned relative to each other and to other attachment members, to further secure stringing members of a pocket. For example, as shown in FIGS. 4, 7, 8, 12, and 13, adjacent sidewall hooks 222 may be positioned near each other, or near an anchor cleat 224, to define an inverted L-shaped opening 238. The opening 238 may provide an interior area larger than an entrance area. In other words, the interior area may have a maximum width wider than the width of the entrance area such that release of a stringing member from the interior area is restricted. A stringing member may be slipped through the smaller entrance area and into the larger interior area, where the stringing member may rest on the arm 236 and be held from exiting the opening 238. Although the sidewall hooks 222 and openings 238 in FIGS. 4, 7-10, 12, and 13 have rounded polygonal shapes, other embodiments may have different shapes that provide arms and narrowed entrance areas.

Figure 13:
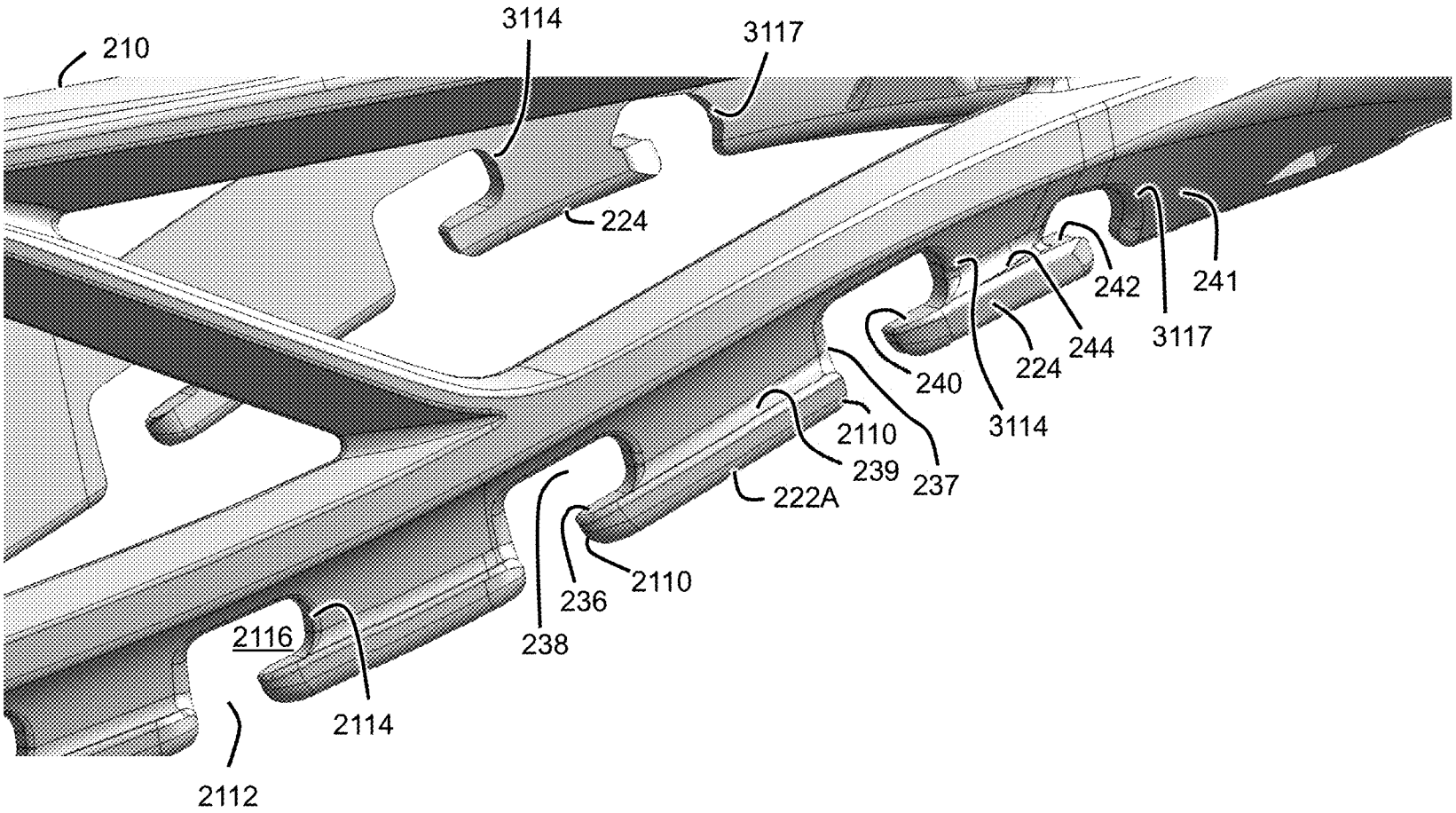

As shown best in FIGS. 12 and 13, a sidewall hook 222 may also include an outer ledge 239 on a side of the sidewall hook 222 opposite to the interior of the lacrosse head. This configuration may allow a pocket stringing member to be routed around the sidewall hook 222, resting on the arm 236 and ledge 239, and wrapping around the straight side 237 of sidewall hook 222 opposite to the side on which arm 236 is disposed. Examples of such pocket stringing member routing are shown in the embodiments of FIGS. 18 and 19. As shown, stringing members of a pocket 1802 may be routed around, and resting upon, the arms and ledges of sidewall hooks 222. In embodiments, a stringing member may rest on arms and ledges of sidewall hooks 222 in a manner similar to that of the rearward cleat 220 shown in FIG. 20.

As shown best in FIGS. 12 and 13, sidewall hooks 222 may also include additional provisions for facilitating convenient stringing of a pocket. In embodiments, referring to the orientation of FIGS. 12 and 13, the lower corners 2110 of the L-shaped sidewall hooks 222 may be rounded or angled outwardly moving in an upward direction toward the interior area 2116 of an opening 238. With this configuration, two adjacent sidewall hooks 222 may define an entrance area 2112 of an opening 238 that narrows in a direction toward the interior area 2116. For example, an entrance area 2112 may be wedge-shaped or funnel-shaped. That configuration may allow a user to more conveniently place a stringing member through the wider outer opening of the entrance area 2112, then through the narrower inner opening of the entrance area 2112, and into the interior area 2116, where the stringing member may be retained due to the arm 236.

To further facilitate convenient stringing and retain stringing members, embodiments may also provide a deflectable portion on a sidewall hook, which may deflect to allow passage of a stringing member, and after the stringing member passes through, may return to its original configuration. The deflectable portion may be provided near an entrance area to an opening, which may be a keyhole opening or another shaped opening, such as a circular or oval opening. The deflectable portion may be provided at the lower corners 2110 of the L-shaped sidewall hooks 222 in manners similar to those described above for the rearward cleats 220. The deflectable portion may be a mechanical feature, such as a living hinge, or a material feature, such as an overmolded material (e.g., thermoplastic elastomer) more flexible than the base material of a lacrosse head frame.

Referring again to the embodiment of FIGS. 4-16, lacrosse head 204 may optionally include means for anchoring the top corners of a pocket, such as the top left and top right openings in the top row of openings of a mesh pocket or traditional pocket. As shown in FIGS. 4 and 6-9, anchor cleats 224 may serve this function. Anchor cleats 224 may be provided at positions forward of the sidewall hooks 222 and rearward of the transverse wall 212 and scoop hooks 226. Anchor cleats 224 may be configured to hold portions of a pocket that tend to be pulled in multiple directions, such as at a corner where a pocket may be pulled in the forward and rearward directions, as well as toward an interior of the pocket area. As shown in FIGS. 4, 7, and 8, for example, an anchor cleat 224 may have an inverted T-shape providing a first arm 240 and a second arm 242. The first arm 240 may be disposed on a rearward side of the base portion of the anchor cleat 224 and the second arm 242 may be disposed on a forward side of the base portion of the anchor cleat 224.

The first arm 240 and second arm 242 may act as interior ledges on which portions of a stringing member may rest. The arms 240, 242 may retain the stringing member as the adjacent pocket portions pull in multiple directions, to avoid disengagement of the stringing member from the anchor cleat 224.

Figure 14:
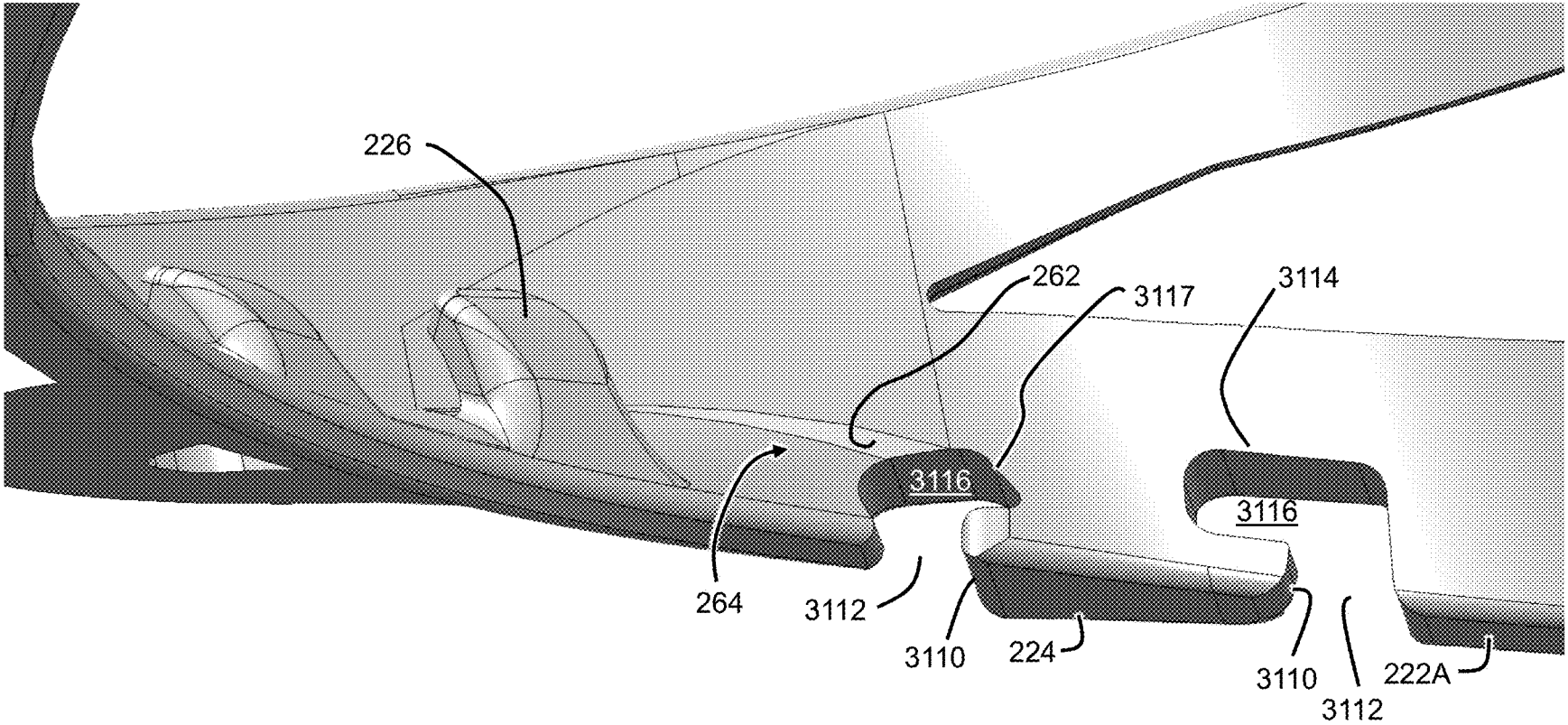
FIG. 14 is a schematic diagram of an enlarged partial view of a sidewall and transverse wall of the lacrosse head of FIG. 4, according to an embodiment.

Anchor cleats 224 may also be positioned relative to other attachment members and other portions of the lacrosse head 204, to further secure stringing members of a pocket. For example, as shown in FIGS. 13 and 14, an anchor cleat 224 may be positioned near a sidewall hook 222A and a portion 241 of the sidewalls 208, 210 and/or transverse wall 212 so as to define a first opening 3114 and a second opening 3117, which may be similar to the keyhole openings 234 and openings 238 described above in the context of the rearward cleats 220 and the sidewall hooks 222. The openings 3114, 3117 may provide an interior area larger than an entrance area, as described above. A stringing member may be slipped through the smaller entrance area and into the larger interior area, where the stringing member may rest on an interior ledge (e.g., arms 240, 242) and be held from exiting the opening. Although the anchor cleats 224 and their associated openings in FIGS. 4, 6-9, 12, and 13 have rounded polygonal shapes, other embodiments may have different shapes that provide arms and narrowed entrance areas.

As shown best in FIG. 13, an anchor cleat 224 may also include an outer ledge 244 on a side of the anchor cleat 224 opposite to the interior of the lacrosse head 204. This configuration may allow a pocket stringing member to be routed around the anchor cleat 224, resting on the arms 240, 242 and ledge 244. Examples of such pocket stringing member routing are shown in the embodiments of FIGS. 18 and 19. As shown, stringing members of a pocket 1802 may be routed around, and resting upon, arms and ledges of anchor cleats 224. In embodiments, a stringing member may rest on arms and ledges of anchor cleats 224 in a manner similar to that of the rearward cleat 220 shown in FIG. 20.

As shown best in FIGS. 13 and 14, anchor cleats 224 may also include additional provisions for facilitating convenient stringing of a pocket. In embodiments, referring to the orientation of FIGS. 13 and 14, the lower corners 3110 of the anchor cleats 224 may be rounded, or angled outwardly from the base portion moving in an upward direction toward the interior areas of openings 3114, 3117. With this configuration, anchor cleats 224, along with their adjacent sidewall hooks 222 and portions 241 of head 204, may define entrance areas 3112 of openings 3114, 3117 that narrow in a direction toward the interior areas 3116. For example, an entrance area 3112 may be wedge-shaped or funnel-shaped. That configuration may allow a user to more conveniently place a stringing member through the wider outer opening of the entrance area 3112, and then through the narrower inner opening into the interior area 3116, where the stringing member may be retained due to the arms 240, 242.

To further facilitate convenient stringing and retain stringing members, embodiments may also provide a deflectable portion on an anchor cleat, which may deflect to allow passage of a stringing member, and after the stringing member passes through, may return to its original configuration. The deflectable portion may be provided near an entrance area to an opening, which may be a keyhole opening or another shaped opening, such as a circular or oval opening. The deflectable portion may be provided at the lower corners 3110 of the anchor cleats 224 in manners similar to those described above for the rearward cleats 220. The deflectable portion may be a mechanical feature, such as a living hinge, or a material feature, such as an overmolded material (e.g., thermoplastic elastomer) more flexible than the base material of a lacrosse head frame.

In alternative embodiments, anchor cleats may not be needed and sidewall hooks may be sufficient. For example, referring to FIGS. 4-10, anchor cleats 224 may be omitted or may be replaced with sidewall hooks.

Figure 15:
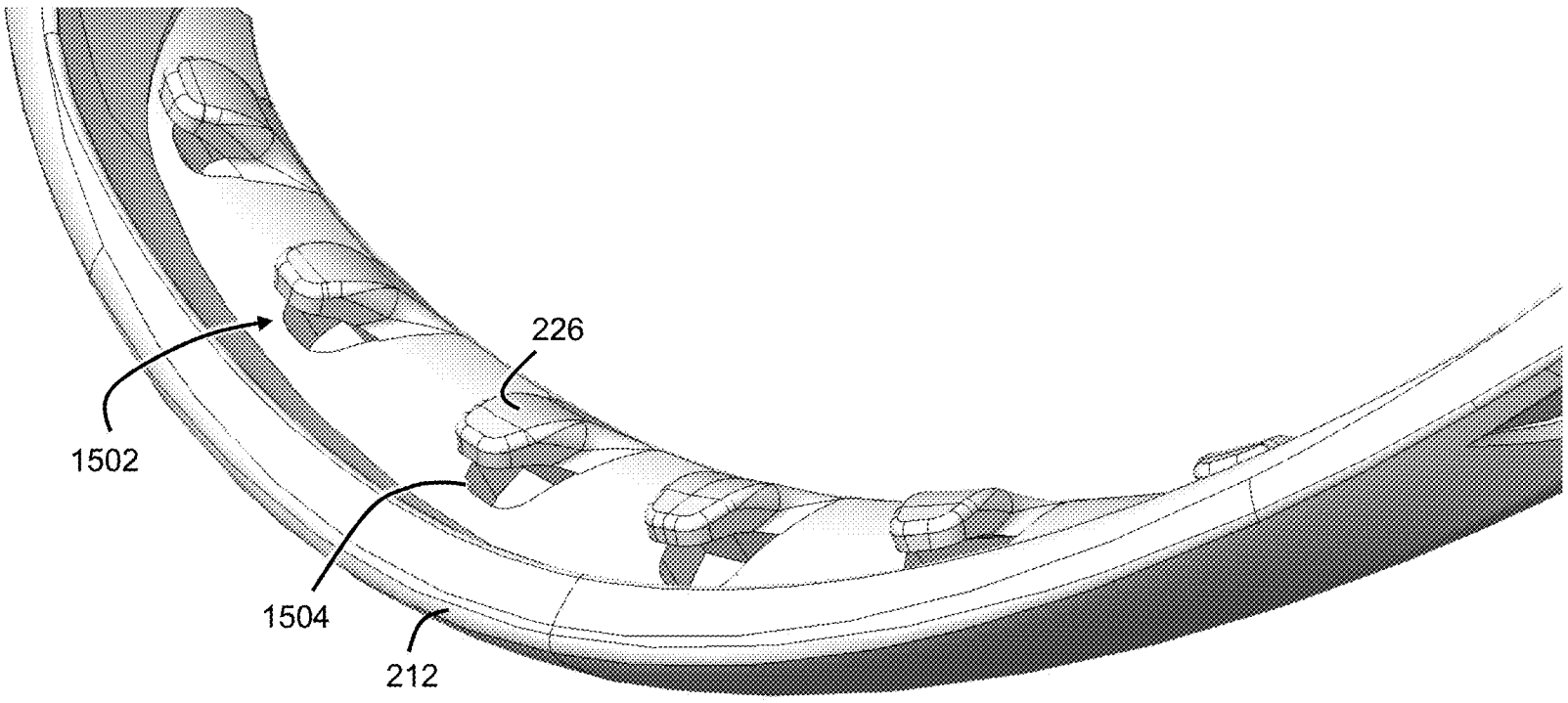
FIG. 15 is a schematic diagram of an enlarged partial view of the transverse wall of the lacrosse head of FIG. 4, according to an embodiment.
Figure 16:
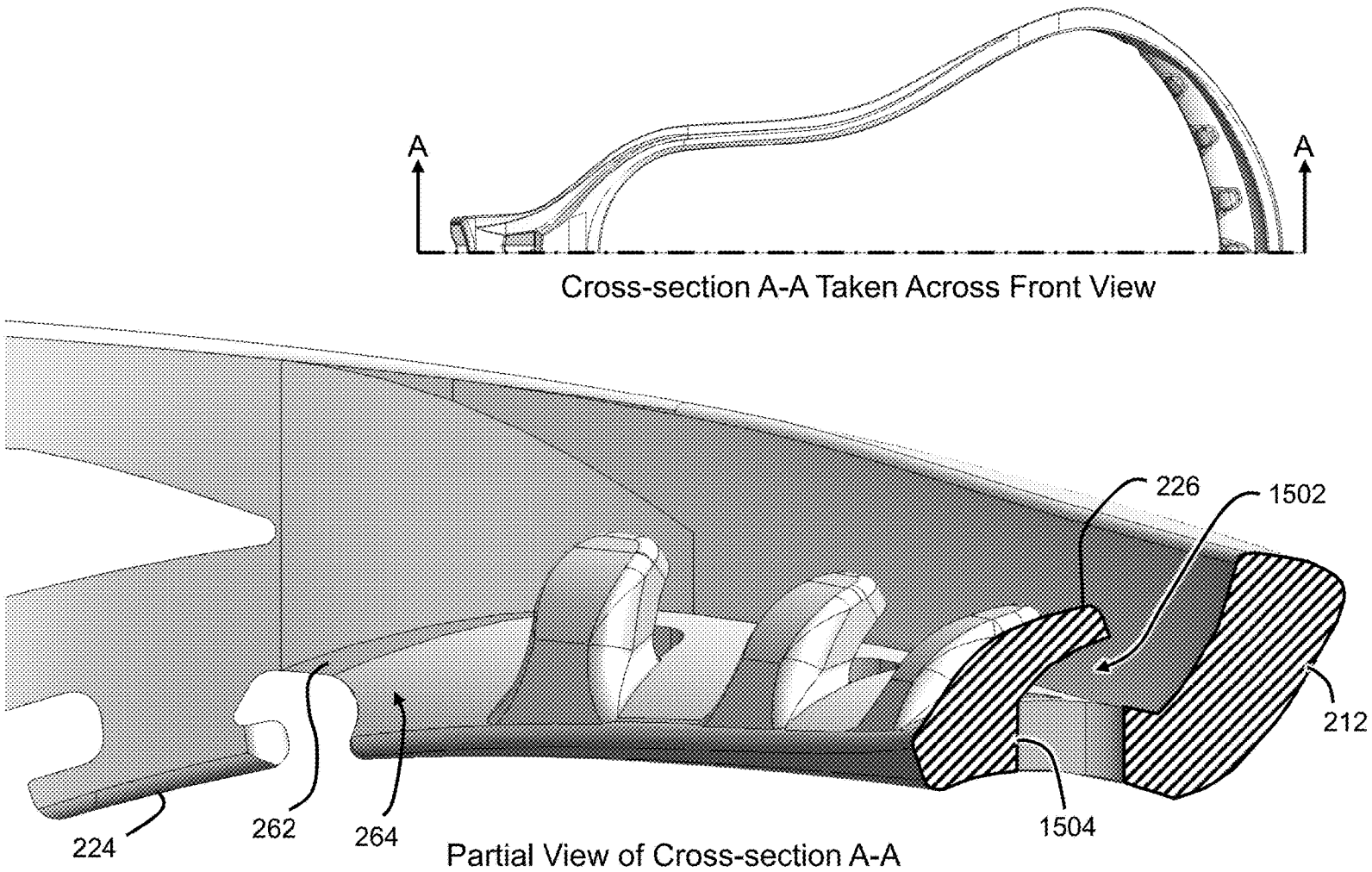
FIG. 16 is a schematic diagram of a partial cross-sectional view of the transverse wall of the lacrosse head of FIG. 4, taken along the line A-A shown in FIG. 16, corresponding to the bisecting line 219 shown in FIG. 5, according to an embodiment.

Referring again to FIGS. 4-16, scoop hooks 226 may provide means for attaching to the transverse wall 212 a stringing member, such as a stringing member that forms a mesh opening of a mesh pocket, or a stringing member that forms a crosslace opening or a thong of a traditional pocket. As shown in FIGS. 4-8, scoop hooks 226 may be provided at positions forward of the anchor cleats 224 and the sidewall hooks 222. Scoop hooks 226 may be configured to hold portions of a pocket that are tensioned in generally a forward-to-rearward direction. As shown in FIG. 4, for example, an individual scoop hook 226 may be an elongated member protruding in a forward direction from the upwardly-facing front face 245 of the transverse wall 212. When viewed from a front view, as in FIG. 5, a scoop hook 226 may have a generally trapezoidal shape, with the opposing rearward and forward sides being parallel, and with the lateral sides angled toward each other in a rearward-to-forward direction. As shown in the partial perspective view of FIG. 15 and the partial cross-sectional view of FIG. 16, an embodiment of scoop hook 226 may define a string-retaining gap 1502 having generally a V-shape, with the scoop hook 226 defining a convex part of the V-shape curving outwardly and the transverse wall 212 defining a concave part of the V-shape curving inwardly. As shown in FIGS. 15 and 16, in embodiments, transverse wall 212 may define an opening 1504 under each scoop hook 226. Openings 1504 may be configured to make the lacrosse head 204 more susceptible to manufacture, for example, with injection molding processes that involve releasing a head from a two-part mold, where a sliding shutoff is used to form the underside of a scoop hook 226. In other words, the gap under each scoop hook 226 may be considered "undercut" in the direction of the scoop face portion of a molding tool and not releasable from the mold without the pass-through opening 1504 under the hook. Scoop hooks 226 may also be formed using more complicated molding and/or manufacturing techniques. Openings 1504 may also beneficially reduce the overall weight of a head, and reduce the weight of the scoop to avoid a top-heavy feel.

In addition, openings 1504 may provide additional options for attaching stringing members to a head.

Figure 5:
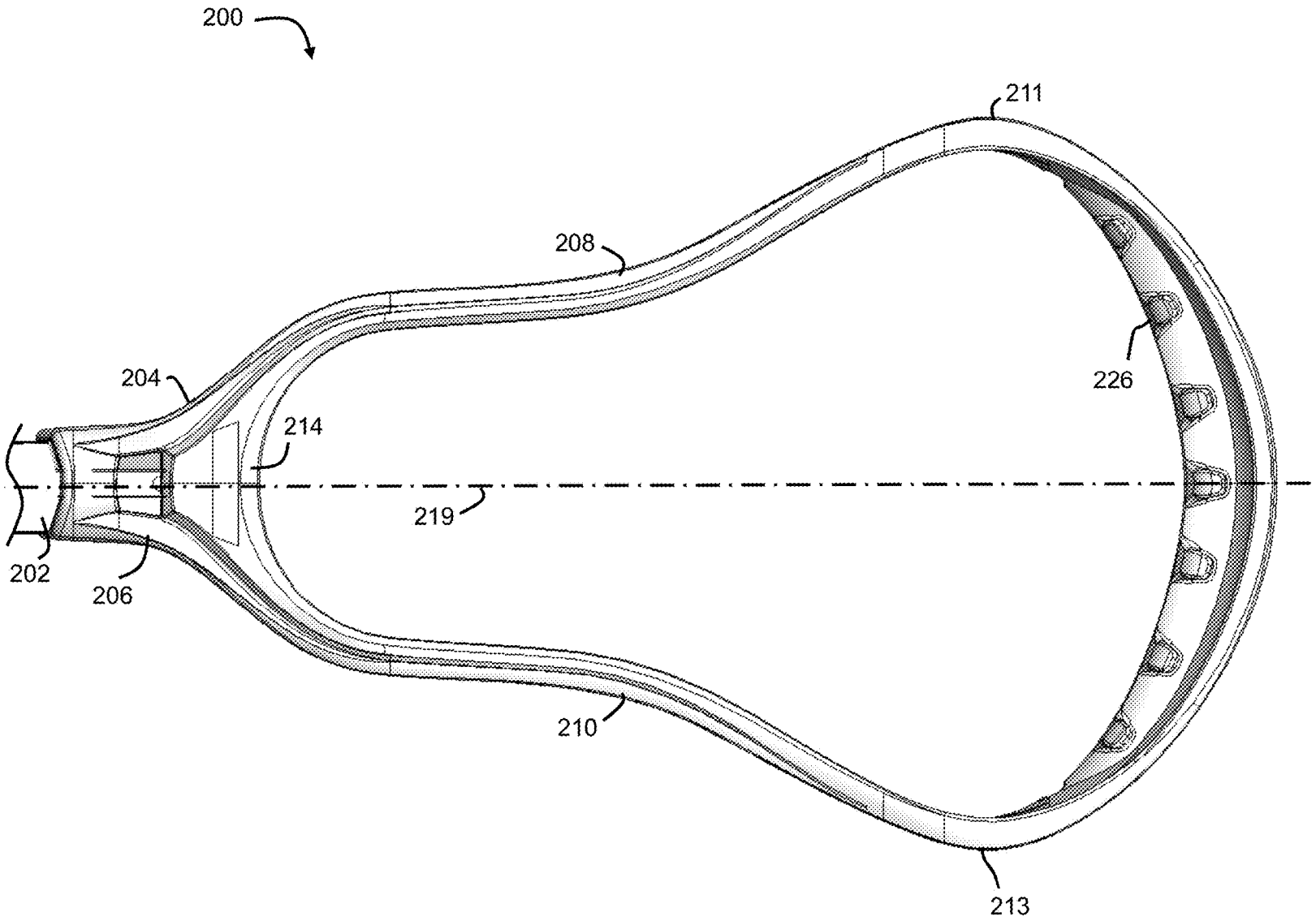
FIG. 5 is a schematic diagram of a front view of a lacrosse stick having a pocket stringing system, including the lacrosse head of FIG. 4 and a handle, according to an embodiment.
Figure 6:
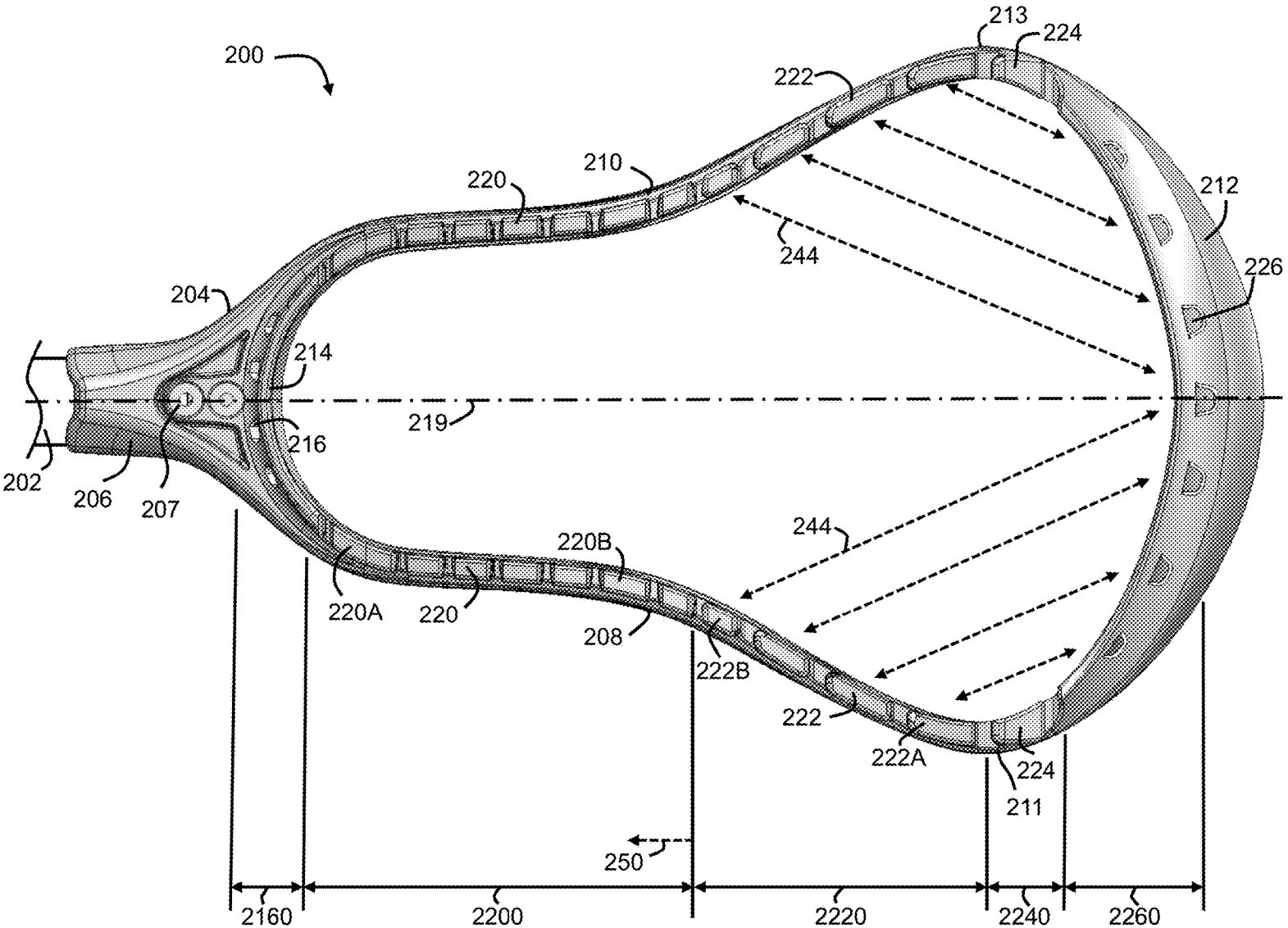
FIG. 6 is a schematic diagram of a rear view of the lacrosse stick of FIG. 5.

Referring to FIGS. 4-6, the scoop hooks 226 may retain the stringing member as the adjacent pocket portions are tensioned in a direction generally in the rearward direction, with greater amounts of tension toward the anchor cleats 224 and the sidewall hooks 222 (for example, as represented by the arrows 244 in FIG. 6), and lesser amounts of tension toward the rearward hooks 220 and the stringing openings 216. In other words, a stringing member may be pulled securely against the inside of a scoop hook 226, which may avoid disengagement of the stringing member from the sidewall hook 226. As shown by the representative arrows 244 in FIG. 6, pocket tension may be provided between pairs of scoop hooks 226 and sidewall hooks 222. Referring to the embodiment of FIG. 19, the rear view on the left and the front view on the right illustrate an example of how the pocket is tensioned according to the arrows 244 of FIG. 6, forming a tighter forward pocket portion 1902 and a ball channel pocket portion 1904 that gradually widens and drops to a rearward ball-retaining pocket portion 1906. In the rear view of FIG. 19 (the image on the left), the tensions apparent from the shapes of the mesh openings illustrate how a ball, starting in the rearward ball-retaining pocket portion 1906 may be beneficially controlled during a throw as the ball travels forward through the ball channel pocket portion 1904, and is centered by the narrowing shape of the ball channel pocket portion 1904 and the tension provided in forward pocket portion 1902, such that the ball is released off of the center of the transverse wall 212.

In embodiments, the quantity, locations, and sizes of the scoop hooks 226 may vary to hold pocket stringing members at particular tensions and locations to form a desired shape of the pocket. For example, as shown in FIG. 5, an embodiment may provide seven scoop hooks 226, with one scoop hook centered on the bisecting line 219, three scoop hooks disposed on one side of the center scoop hook, three scoops disposed on the opposite side of the center scoop hook, and all of the scoops spaced roughly equally apart. That configuration, along with the two anchor cleats 224, may accommodate, for example, a mesh pocket having a top row of nine openings 91-99, as shown in the embodiment of FIG. 19. Mesh openings 91, 99, which may be disposed at the top corners of a mesh, may attach to the anchor cleats 224. The seven remaining mesh openings 92-98 of the top row of mesh openings may attach to the seven scoop hooks 226. That configuration of sidewall hooks 226, anchor cleats 224, and sidewall hooks 222 may help provide the tension described above in reference to arrows 244, anchoring the mesh at its corners, and pulling the pocket between pairs of scoop hooks and sidewall hooks, with the center scoop hook pulling against two opposing sidewall hooks. That tension may pull the pocket into a beneficial triangular shape in the forward portion of the pocket area, while forming a ball channel in the pocket along the bisecting line, as shown in the front and rear views of FIG. 19.

Figure 22:
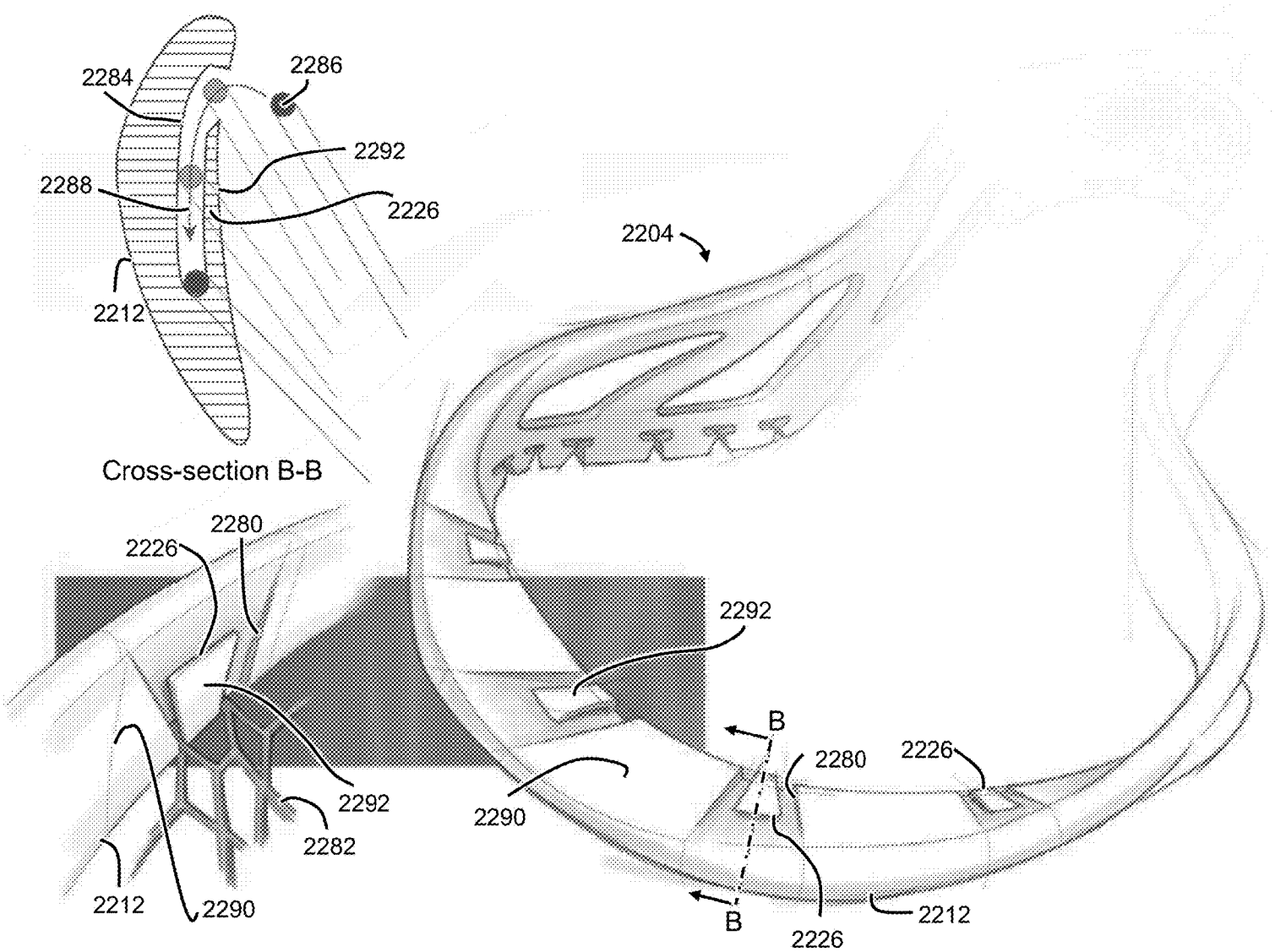
FIG. 22 is a schematic diagram of partial perspective views of a lacrosse head having scoop hooks, along with a cross-sectional view of a scoop hook, according to an embodiment.

Although FIGS. 5 and 16 illustrate scoop hooks 226 having particular front view and cross-sectional shapes, other embodiments may have different shapes that provide string-retaining gaps. For example, instead of the rounded trapezoidal shapes seen in FIG. 5, the scoop hooks 226 may be shaped generally as triangles, rectangles, squares, circles, or ovals. In addition, the scoop hooks 226 and transverse wall 212 may define string-retaining gaps having different shapes, such as a U-shape, a keyhole, or a slot. As an example, FIG. 22 illustrates an embodiment in which a transverse wall 2212 of a lacrosse head 2204 defines recesses 2280 in which scoop hooks 2226 are disposed. Scoop hooks 2226 may be L-shaped tongues that receive stringing members of a pocket, such as a stringing member of a mesh opening of a mesh pocket 2282. As shown in the cross-sectional view B-B of FIG. 22, the scoop hook 2226 may define a slot 2284 through which a stringing member 2286 may be passed (as represented by the arrow 2288) until the stringing member 2286 reaches the bottom of the slot 2284, where the stringing member 2286 may be held and tensioned. The recesses 2280 around the scoop hooks 2226 may allow a stringing member 2286 to be routed around the sides of a scoop hook 2226 and below the upwardly-facing front face 2290 of the transverse wall 2212, which may avoid wear on the stringing member 2286 due to contact with a ball and other objects. An outer surface 2292 of a scoop hook 2226 may also be generally continuous with the surfaces of the transverse wall 2212, such as the face 2290, which may avoid wear on the scoop hooks 2226 due to contact with a ball or other objects, and which may also avoid affecting the control of the ball.

In the embodiments of FIGS. 4-16, the different types of attachment members and the zones in which they are applied may provide a desired pocket shape, such as a cup-shaped rearward ball-retaining portion that enhances ball control and retention within a lacrosse head, and a ball channel that narrows in the rearward-to-forward direction and facilitates accurate passing, shooting, and catching. As shown in FIGS. 6 and 7, moving in a rearward-to-forward direction, the zones may be positioned sequentially starting with stop member stringing zone 2160, then rearward cleat zone 2200, then sidewall hook zone 2220, then anchor cleat zone 2240, and finally scoop hook zone 2260. Each zone may include a number of its corresponding attachment member type appropriate for securing the particular pocket (e.g., the number of openings in a mesh pocket). The stop member stringing zone 2160 may secure a rearwardmost portion of the pocket and pull generally in the rearward direction against the scoop hook zone 2260. The rearward cleat zone 2200 may secure a rearward portion of the pocket and allow that portion to hang loosely in a rounded shape and to swing freely. The sidewall hook zone 2220 may secure a middle and/or forward portion of the pocket, pulling that portion of the pocket upward from the bottom of the rounded rearward ball-retaining pocket portion to decrease the depth of the pocket, and pulling tighter against the scoop hook zone 2260 to form a ball channel in the pocket, as represented by the arrows 244 in FIG. 6, which narrows in the rearward-to-forward direction from the rearward side of the sidewall hook zone 2220 to the scoop hook zone 2220. The anchor cleat zone 2240 may hold top corner portions of the pocket. The scoop hook zone 2260 may secure a forwardmost portion of the pocket, pulling that portion of the pocket upward from the ball-retaining pocket portion formed at the rearward cleat zone 2200 and generally against the stop member stringing zone 2160, and pulling tighter against the sidewall hook zone 2220, as represented by the arrows 244 in FIG. 6.

In embodiments, the quantities, sizes, and locations of individual attachment members within the zones may vary to provide desired pocket shapes, as described above. In addition, the lengths of the zones in the rearward-to-forward direction may vary to provide desired pocket shapes. For example, referring to FIGS. 6, 7, and 19, to provide a longer, narrower ball channel and a shorter ball-retaining portion, embodiments may shorten the rearward cleat zone 2200 and lengthen the sidewall hook zone 2220 (as represented by dashed arrows 250), so that the tension between the scoop hook zone 2260 and the sidewall hook zone 2220 extends farther in the rearward direction. In other words, that configuration may provide directions of tension, as represented by arrows 244, that are at smaller angles relative to the bisecting line 219, which may lengthen and narrow the ball channel.

Embodiments may also include provisions for transitioning between attachment members that hold stringing members from different directions. For example, as in the embodiments of FIGS. 4-16, the rearward cleats 220, sidewall hooks 222, and anchor cleats 224 may project downwardly and hold stringing members from a lower portion of a lacrosse head frame, whereas scoop hooks 226 may project upwardly and hold stringing members from an upper portion of a lacrosse head frame. A pocket attached to such a configuration may therefore need to transition between the downwardly and upwardly projecting attachment members. A lacrosse head frame may therefore define passageways to route a stringing member between the differently oriented attachment members. As an example, as shown in FIGS. 4, 9, 14, and 16, an embodiment may provide a transverse wall 212 having an undercut 262 defining a passageway 264 between an anchor cleat 224 and a scoop hook 226. The undercut 262 may define the passageway 264 extending from the anchor cleat 224 to the upwardly-facing front face 245 of the scoop 212. The passageway 264 may be configured to route a stringing member of the pocket from the anchor cleat 224 at the lower portion of the sidewall 208 to the scoop hook 226 that is closest to the anchor cleat 224. The undercut 262 may allow a stringing member to smoothly transition from an underside of the lacrosse head 204 at the anchor cleat 224 to a top side of the lacrosse head 204 at the scoop hook 226, as shown in FIG. 19. The smooth transition provided by the undercut 264 may reduce stress and wear on a stringing member.

Alternative embodiments may position attachment members at different positions of a lacrosse head frame. For example, referring to FIGS. 1-3, scoop hooks 226 may be provided on the opposite, downwardly-facing side of transverse wall 212, or may be provided at an edge of the transverse wall 212. As another example, referring again to FIGS. 1-3, rearward cleats 220, sidewall hooks 222, and/or anchor cleats 224, instead of extending vertically downward, may extend vertically upward from a portion of the lacrosse head frame (e.g., a lower rail 170 of a sidewall 108, 110), or may extend horizontally from an inside face or outside face of the lacrosse head frame (e.g., from the stop member 214 or from a sidewall 108, 110).

Figure 23:
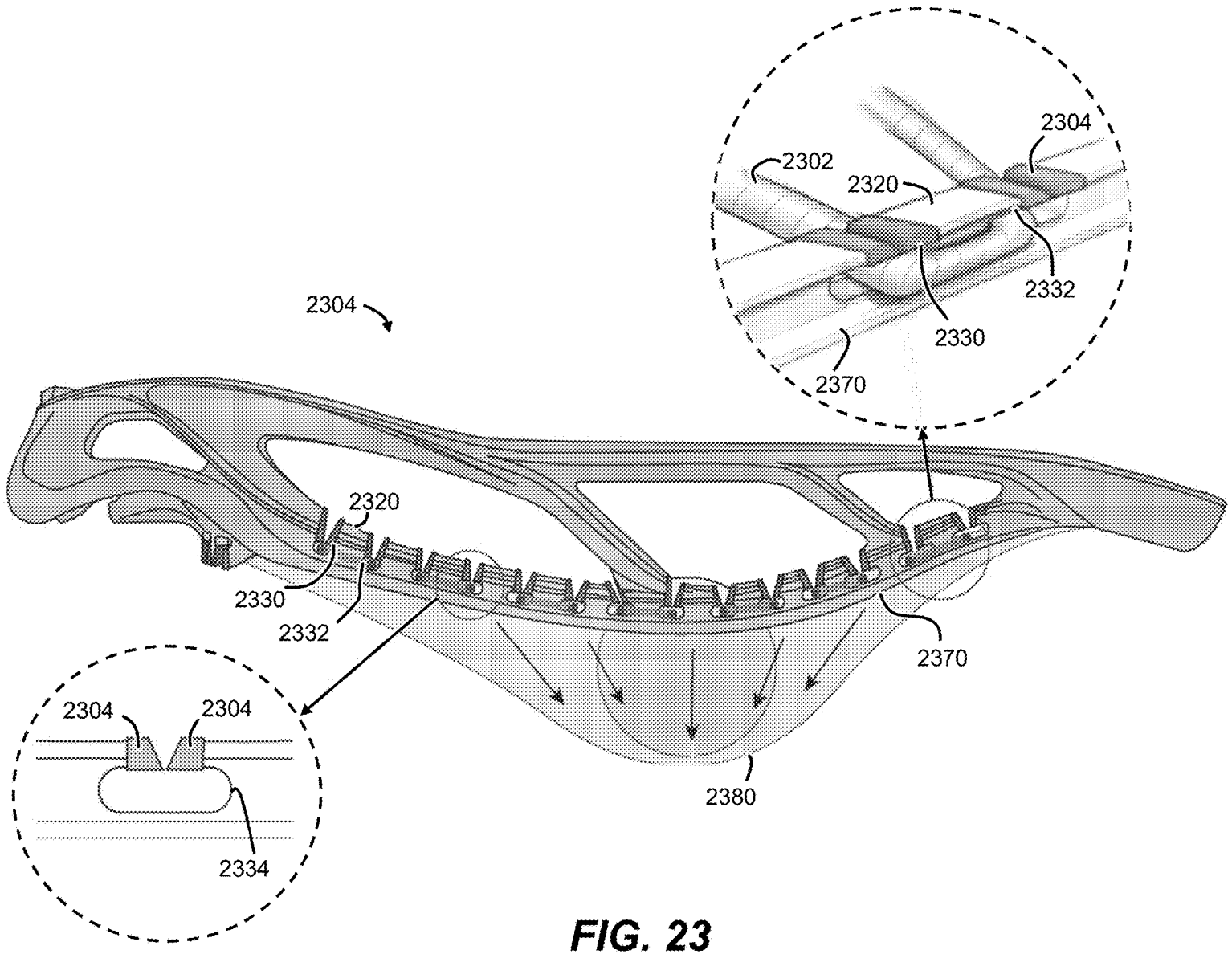
FIG. 23 is a schematic diagram of a side elevational view of a lacrosse head having attachment members projecting vertically upward, along with enlarged partial views of attachment members, according to an embodiment.

As an example, FIG. 23 illustrates an alternative embodiment in which cleats 2320 extend vertically upward. Each cleat 2320 may extend vertically upward from a lower rail 2370 of a lacrosse head 2304, and may be generally T-shaped and define a first arm 2330 and a second arm 2332, under which a stringing member 2302 may be retained. Adjacent cleats 2320 may define openings 2334 in which stringing member 2302 may be disposed. The stringing member 2302 may be a portion of a mesh diamond opening of a mesh pocket, and may wrap around the base portion of the cleat 2320 and within the arms 2330, 2332, as shown in FIG. 23. The arms 2330, 2332 may have deflectable portions 2304 as described above in previous embodiments. In embodiments, orienting the cleats 2320 to extend vertically upward may allow a pocket 2380 to pull downward on an upper side of a lower rail 2370 as shown in FIG. 23, to provide stress regions in a lacrosse head frame different from embodiments in which attachment members extend vertically downward.

Figure 24:
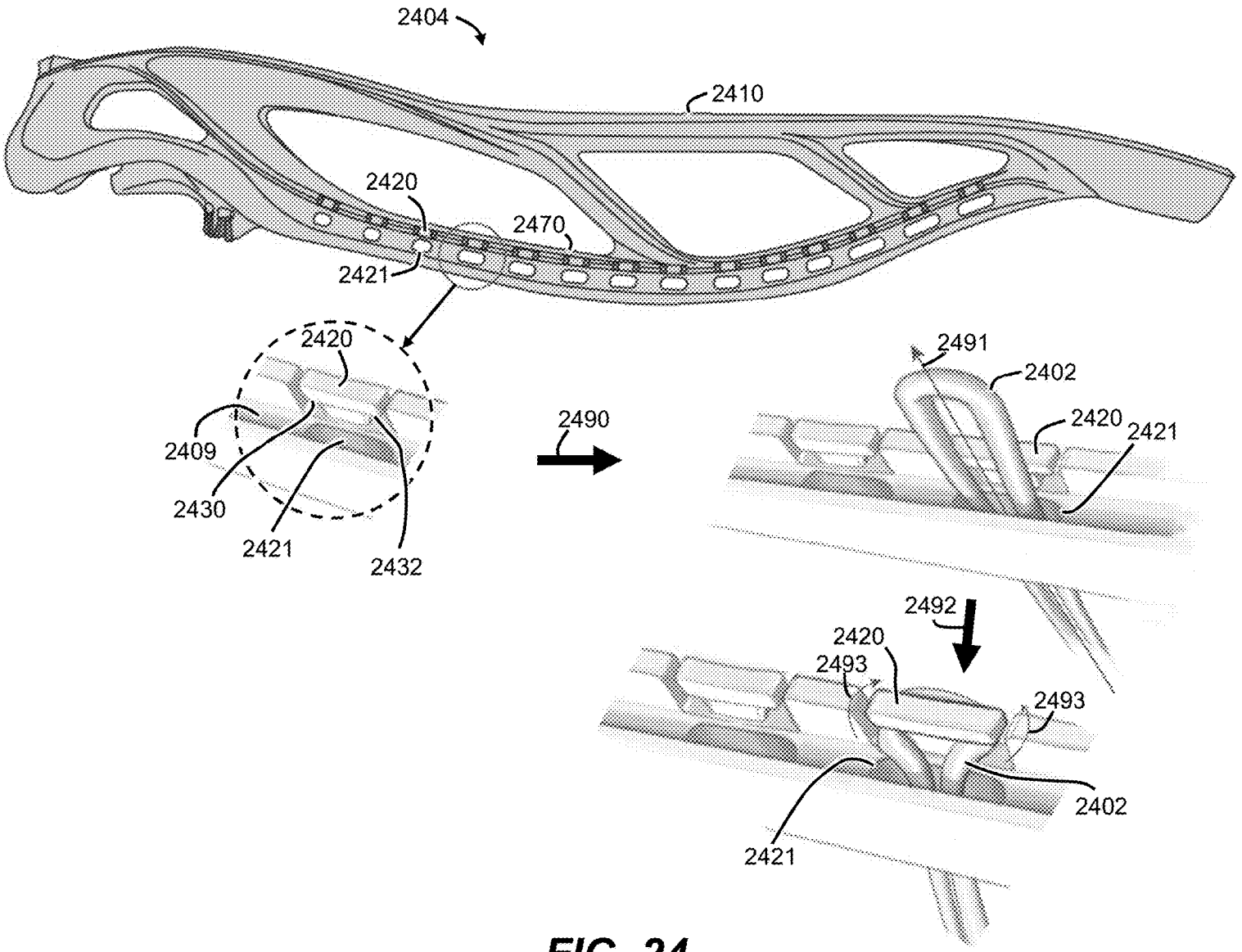
FIG. 24 is a schematic diagram of a side elevational view of a lacrosse head having attachment members projecting horizontally outward with openings disposed below the attachment members, along with enlarged partial perspective views showing attachment members and methods for attaching a stringing member, according to an embodiment.
Figure 25:
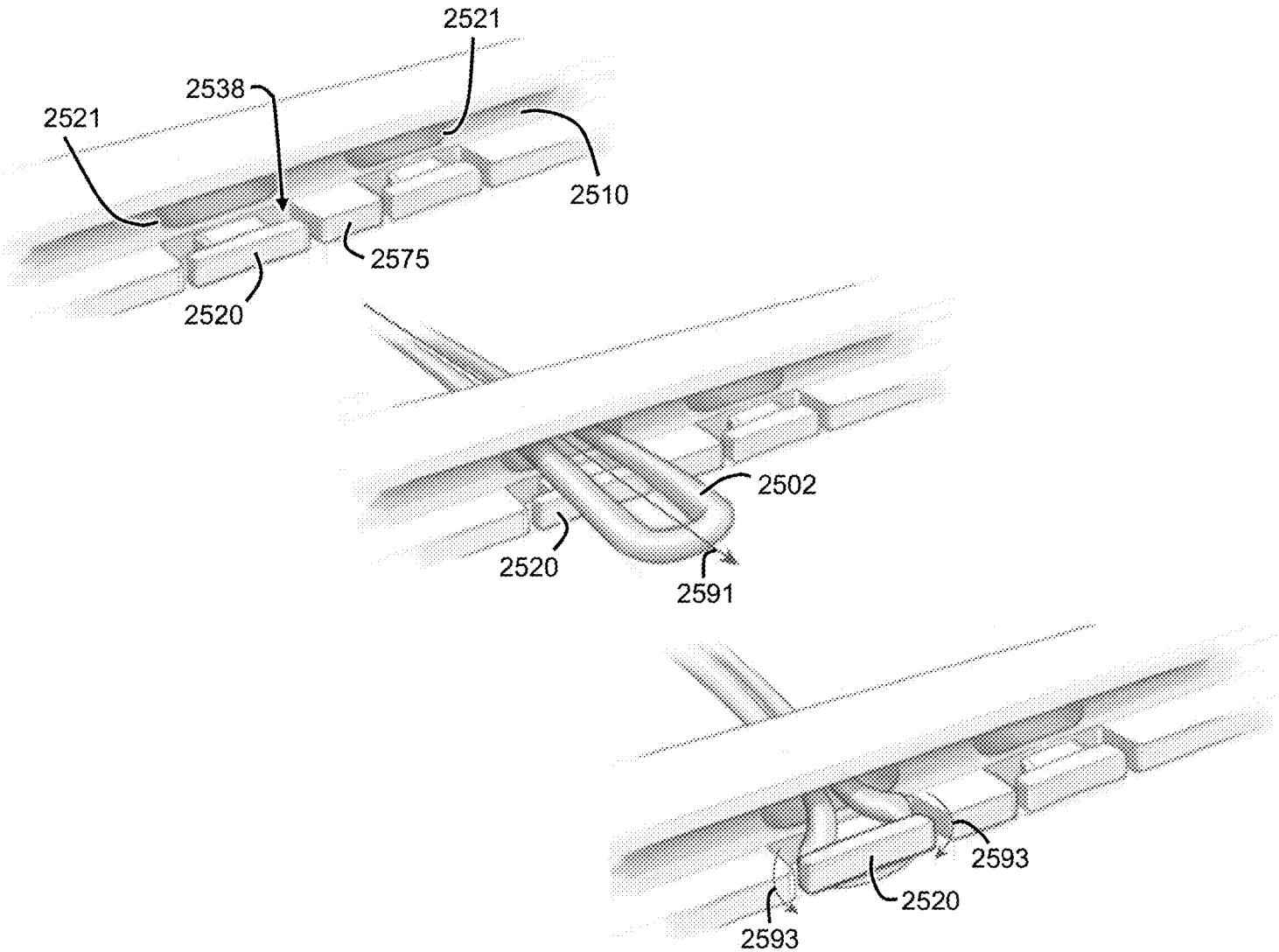
FIG. 25 is a schematic diagram of enlarged partial views of attachment members projecting horizontally with openings disposed above the attachment members, according to an embodiment.

FIG. 24 illustrates another alternative embodiment in which cleats 2420 extend horizontally from an outside face 2409 of a sidewall 2410 of a lacrosse head 2404. Each cleat 2420 may be generally T-shaped and define a first arm 2430 and a second arm 2432, within which a stringing member may be retained. The stringing member may be secured to cleat 2420 from below by wrapping around the underside of sidewall 2410, or from above by wrapping over the lower rail 2470 of sidewall 2410. In other embodiments, a lacrosse head frame may define an opening proximate to each cleat, through which a loop of a stringing member may be routed and then looped around and secured to the cleat, within the arms. For example, as shown in FIG. 24, sidewall 2410 may define an opening 2421 proximate to each cleat 2420, and a loop of stringing member 2402 may be passed through the opening 2421 (as represented by arrow 2491 in the schematic following arrow 2490) and up and around the cleat 2420 (as represented by the arrows 2493 in the schematic following arrow 2492). Alternatively, as shown in FIG. 25, an opening 2521 may be defined above a cleat 2520, and a loop of a stringing member 2502 may be passed through the opening 2521 (as represented by arrow 2591) and down and around the cleat 2520 (as represented by arrows 2593). Configurations with such pairs of cleats and proximate openings may provide increased support of the pocket and may decrease the stress on the cleats.

In embodiments, rather than positioning cleats directly adjacent to each other (e.g., as in FIG. 7 above), cleats may be separated by spacers 2575 as shown in FIG. 25, for example. A spacer 2575 and adjacent cleat 2520 may define an opening 2538 with a narrowed entrance area and a wider string-retaining area, as shown in FIG. 25. In embodiments, the spacers 2575 may provide for an appropriate distance between openings 2521 to avoid weakening a sidewall 2510.

In another embodiment, instead of extending horizontally from an outside sidewall face as in FIG. 24, cleats may extend horizontally from an inside sidewall face toward an interior of a lacrosse head frame.

Although embodiments are described herein in the context of mesh pockets, the embodiments are also applicable to traditional pockets described above, including pre-strung traditional pockets that may be attached a single unit.

Although embodiments described herein may provide an intermediate pocket position (or mid-pocket), other embodiments may provide attachment member configurations that form a rearward pocket position (low pocket) or a forward pocket position (high pocket). For example, relative to the embodiment of FIG. 3, other embodiments may modify the total number of attachment members on the sidewalls and/or the distances between attachment members of the sidewalls. In one implementation, to form a rearward pocket position (low pocket), moving in a rearward-to-forward direction, on each sidewall, adjacent sidewall attachment members after the fifth rearward cleat 120 may be disposed farther apart from each other than the first five sidewall attachment members, and there may be one fewer sidewall attachment member as compared to the embodiment of FIG. 3. In another implementation, to form a forward pocket position (high pocket), moving in a rearward-to-forward direction, on each sidewall, the fourth, fifth, sixth, seventh, and eighth sidewall attachment members may be closer to each other than the distances between the remaining adjacent sidewall attachment members, and there may be one additional sidewall attachment member as compared to the embodiment of FIG. 3.

Embodiments may also include provisions for forming any one of a rearward, intermediate, or forward pocket position on a single lacrosse head. For example, embodiments may provide a lacrosse head having a maximum amount of attachment members possible, which would allow a user the option to move the pocket placement around. For example, to form a low pocket, a user may skip an attachment member to move the pocket position rearwardly towards the juncture.

In embodiments, a lacrosse head may be a competition lacrosse head constructed in compliance with widely-accepted women's and men's lacrosse competition rules, such as those promulgated by US Lacrosse, the National Federation of State High School Associations (NFHS), and the National Collegiate Athletic Association (NCAA).

Figure 26:
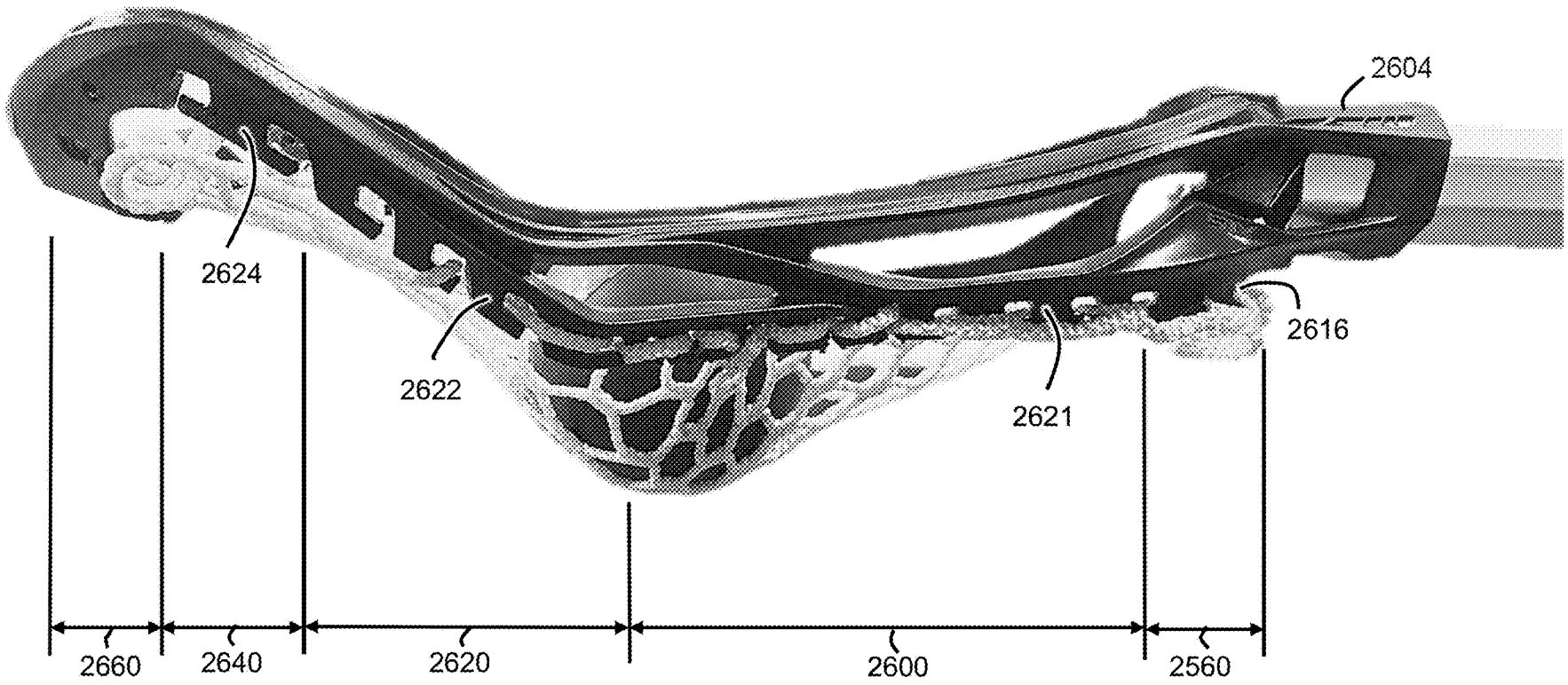
FIG. 26 is a schematic diagram of a side elevational view of a women's lacrosse head having a pocket stringing system, according to another embodiment.

In addition, although some embodiments are presented herein in the context of men's lacrosse heads, all embodiments should be considered broadly applicable to any type of lacrosse head, including, for example, women's lacrosse heads, recreational lacrosse heads, and toy lacrosse heads. Referring to FIG. 26, for example, one embodiment may provide a women's lacrosse head 2604 having a layout of attachment members similar to that of the men's lacrosse head 104 of FIGS. 1-3. As shown, moving in a rearward-to-forward direction (right to left in FIG. 26), lacrosse head 2604 may have a stop member stringing zone 2560, then rearward cleat zone 2600, then sidewall hook zone 2620, then anchor cleat zone 2640, and finally, scoop hook zone 2660. The attachment members of each zone may pull a pocket in manners similar to those described above for lacrosse head 104, and may vary in quantities, sizes, and locations within the zones to provide desired pocket shapes, as described above, as well as to provide desired shapes particular to women's lacrosse heads. In an embodiment, as shown in FIG. 26, lacrosse head 2604 may have four stop member stringing openings 2616, eight rearward cleats 2621 on each sidewall, four sidewall hooks 2622 on each sidewall, one anchoring means 2624 on each side of the lacrosse head 2604, and seven scoop hooks (not shown). Other zones, quantities, sizes, and locations are possible, including configurations that anchor and tension a pocket to create in the pocket a desired channel and deep point that fall within rules specifying the construction of a lacrosse head (e.g., in terms of geometry and pocket depth), such as the NCAA Women's Lacrosse 2020 and 2021 Rules or the NCAA Men's Lacrosse 2019 and 2020 Rules.

Overall, embodiments disclosed herein may provide a lacrosse head to which a pocket may be attached with minimal or no additional stringing elements, e.g., using just the mesh material, the head, and perhaps one stringing cord through stop member openings. By strategically placing the attachment members (e.g., rearward cleats, sidewall hooks, anchor cleats, and/or scoop hooks) in zones of the lacrosse head frame, embodiments may tension and shape the openings of a pocket (e.g., diamond openings of a mesh pocket) to form a desired pocket shape. The attachment members may provide means for direct attachment of the pocket to the lacrosse head. The direct attachment and minimal pocket elements may provide an intuitive system for stringing a lacrosse head, which inexperienced users may easily master.

In facilitating quick, convenient stringing, embodiments may also include provisions for changing pockets to accommodate different playing conditions, e.g., based on weather or based on the desired style of play (such as competitive or recreational). As an example, embodiments may provide a lacrosse head with multiple pockets, each having different performance characteristics, such as soft mesh, hard mesh, or different sizes, shapes, or numbers of openings. Due to the direct attachment configurations, a player may conveniently swap out pockets in a "plug and play" fashion to adjust the performance characteristics of the pocket and the overall lacrosse stick as desired.

As used herein, the "centerline" refers to the centerline of the majority of a handle. In the case of a straight handle, the centerline coincides with the center longitudinal axis of the straight handle. In instances of handles having angled end portions inserted into lacrosse head frames, or in instances of angled juncture (or throat sections) of lacrosse heads, the centerline would be defined by the remaining majority length of the handle that extends away from the angled end portion or angled juncture, and that is held by a player. For example, referring to FIG. 3, if handle 102 bends within the last few inches (e.g., 3 inches) of the end of the handle 102 at a 10 degree angle, with the bent end portion disposed inside the socket of juncture 106, then that bent end portion is to be ignored for purposes of the centerline. Thus, in the example of FIG. 3, the horizontal line 121, which corresponds to the majority length of the handle 102, is the centerline for purposes of the present embodiments.

Examples of suitable materials for a lacrosse head according to the present embodiments include nylon, composite materials, elastomers, metal, urethane, polycarbonate, polyethylene, polypropylene, polyketone, polybutylene terephalate, acetals (e.g., Delrin™ by DuPont), acrylonitrile-butadiene-styrene (ABS), acrylic, acrylic-styrene-acrylonitrile (ASA), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), and polyvinyl chloride (PVC). Examples of suitable materials for a handle according to the present embodiments include wood, metal (e.g., aluminum, titanium, scandium, CU31, C405, and C555), plastic, and composites.

As used herein, the term "point" refers generally to a dimensional position and not necessarily to a single point, and may include one or more points.

As used herein, the term "sidewall rail" refers generally to the edge or surface of a sidewall running along the upper or lower portion of the sidewall. In this respect, a sidewall rail does not have to be a bar-like member as illustrated in open-sidewall embodiments described herein, and could instead be an integral member of a closed sidewall configuration, in which the upper edge of the closed sidewall can be considered an upper sidewall rail and the lower edge of the closed sidewall can be considered a lower sidewall rail. In addition, a sidewall rail could also be both bar-like and integral in a partially open sidewall configuration, for example, where the openings do not extend the full length of the sidewall, or in areas where a sidewall typically decreases in height and assumes a solid construction through the height, such as near the stop member or the transverse wall. Accordingly, notwithstanding the particular embodiments illustrated herein, the term "sidewall rail" should be broadly interpreted to cover any upper or lower edge or surface portion of a sidewall.

For purposes of convenience various directional adjectives are used in describing the embodiments. For example, the description may refer to the top, bottom, and side portions or surfaces of a component. It may be appreciated that these are only intended to be relative terms and, for example, the top and bottom portions may not always be aligned with vertical up and down directions depending on the orientation of a component or lacrosse stick.

It should also be noted that relative terms such as "upper," "lower," "top," and "bottom," are used herein to describe the embodiments as depicted in the accompanying figures and are not intended to be limiting. Unless the context of the usage dictates otherwise, when used in reference to a lacrosse stick or head as a whole, the term "front" refers to the side of the lacrosse stick through which a ball is caught and the terms "back" and "rear" refer to the side of the lacrosse stick that is opposite to the "front" and is where the pocket is disposed. It should also be noted that figures provided herein generally depict the illustrated lacrosse head with the pocket side of the head (i.e., the rear) facing downward. It will be apparent to skilled practitioners that the orientation of a lacrosse stick varies dramatically during play and the relative positions of the elements of the present embodiments will similarly vary from those depicted.

The foregoing disclosure of the preferred embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A lacrosse head, comprising:

a juncture configured to receive a handle, the juncture defining a bisecting line when the lacrosse head is viewed from a front view;

a stop member adjoining the juncture;

a first sidewall extending from the stop member in a forward direction and having a first lower portion when viewed from a side view;

a second sidewall extending from the stop member in the forward direction and having a second lower portion when viewed from the side view;

a scoop connecting the first sidewall and the second sidewall opposite to the stop member, and, when viewed from the side view, having an upwardly facing front face and a downwardly facing rear face, wherein the stop member, the scoop, the first sidewall, and the second sidewall form a pocket area extending in a rearward-to-forward direction from a first point on the stop member at the bisecting line to a second point at a distal edge of the scoop at the bisecting line, wherein the scoop and the first sidewall adjoin each other to form a first shoulder portion of the lacrosse head and the scoop and the second sidewall adjoin each other to form a second shoulder portion of the lacrosse head;

a plurality of first cleats protruding from the first lower portion of the first sidewall at a rearward portion of the pocket area nearest the juncture, wherein each first cleat has a rearwardly-projecting arm projecting rearwardly in a direction parallel to the first lower portion of the first sidewall at the rearward portion and a forwardly-projecting arm projecting forwardly in a direction parallel to the first lower portion of the first sidewall at the rearward portion;

a plurality of second cleats protruding from the second lower portion of the second sidewall at the rearward portion of the pocket area nearest the stop member, wherein each second cleat has a rearwardly-projecting arm projecting rearwardly in a direction parallel to the second lower portion of the second sidewall at the rearward portion and a forwardly-projecting arm projecting forwardly in a direction parallel to the second lower portion of the second sidewall at the rearward portion;

a plurality of first sidewall hooks protruding from the first lower portion of the first sidewall at a forward portion of the pocket area forward of the rearward portion, wherein each first sidewall hook has a rearwardly-projecting arm projecting rearwardly in a direction parallel to the first lower portion of the first sidewall at the forward portion;

a plurality of second sidewall hooks protruding from the second lower portion of the second sidewall at the forward portion of the pocket area forward of the rearward portion, wherein each second sidewall hook has a rearwardly-projecting arm projecting rearwardly in a direction parallel to the second lower portion of the second sidewall at the forward portion;

a plurality of scoop hooks each of which, when viewed from the side view, protrudes from the front face of the scoop upwardly and in the forward direction, and wherein the plurality of scoop hooks includes a first lateral scoop hook disposed on a first side of the bisecting line nearest the first sidewall, and a second lateral scoop hook disposed on a second side of the bisecting line nearest the second sidewall; and a pocket removably attached to the first lateral scoop hook, a first sidewall hook of the plurality of first sidewall hooks, the second lateral scoop hook, and a second sidewall hook of the plurality of second sidewall hooks, wherein a first stringing member of the pocket extends around a forward side of the first lateral scoop hook and is removably held between the first lateral scoop hook and the front face of the scoop, wherein a second stringing member of the pocket extends around the first sidewall hook and is removably held between the rearwardly-projecting arm of the first sidewall hook and the first lower portion of the first sidewall, wherein a third stringing member of the pocket extends around a forward side of the second lateral scoop hook and is removably held between the second lateral scoop hook and the front face of the scoop, wherein a fourth stringing member of the pocket extends around the second sidewall hook and is removably held between the rearwardly-projecting arm of the second sidewall hook and the second lower portion of the second sidewall, and wherein:

the first lateral scoop hook tensions the pocket toward the first sidewall hook of the plurality of first sidewall hooks, and the second lateral scoop hook tensions the pocket toward the second sidewall hook of the plurality of second sidewall hooks, so as to form a ball channel in the pocket.

2. The lacrosse head of claim 1, wherein the plurality of scoop hooks includes a third lateral scoop hook disposed on the first side farther from the bisecting line than the first lateral scoop hook and a fourth lateral scoop hook disposed on the second side farther from the bisecting line than the second lateral scoop hook, wherein the pocket is attached to the third lateral scoop hook, a second adjacent first sidewall hook positioned adjacent to and forward of the first sidewall hook, the fourth lateral scoop hook, and a second adjacent second sidewall hook positioned adjacent to and forward of the second sidewall hook, and wherein the third lateral scoop hook tensions the pocket toward the second adjacent first sidewall hook, and wherein the fourth lateral scoop hook tensions the pocket toward the second adjacent second sidewall hook.

3. The lacrosse head of claim 1, wherein the plurality of scoop hooks includes a center scoop hook disposed on the bisecting line, wherein the pocket is attached to the center scoop hook, a rearwardmost first sidewall hook positioned nearest the juncture, and a rearwardmost second sidewall hook positioned nearest the juncture and wherein the center scoop hook tensions the pocket toward the rearwardmost first sidewall hook and toward the rearwardmost second sidewall hook.

4. The lacrosse head of claim 1, wherein, when viewed from the side view, each first sidewall hook of the plurality of first sidewall hooks has a width, as measured along the rearwardly-projecting arm, narrower than a next adjacent first sidewall hook that is forward of each first sidewall hook such that the first sidewall hooks successively increase in width moving in the rearward-to-forward direction.

5. The lacrosse head of claim 1, wherein each first cleat of the plurality of first cleats and each second cleat of the plurality of second cleats comprise an inverted T-shaped protrusion when viewed from the side view.

6. The lacrosse head of claim 1, wherein each of the rearwardly-projecting arm and the forwardly-projecting arm of each first cleat of the plurality of first cleats has an angled distal edge such that, when viewed from the side view, the each of the rearwardly-projecting arm and the forwardly-projecting arm is longer at its top longitudinal side than its bottom longitudinal side, and such that adjacent first cleats define a gap that decreases in size in an upward direction when viewed from the side view.

7. The lacrosse head of claim 6, wherein each of the rearwardly-projecting arm and the forwardly-projecting arm of each first cleat of the plurality of first cleats has a first base portion that is made of a first material and a second distal portion that forms the angled distal edge and is made of a second material, and wherein the second material is more flexible than the first material such that the angled distal edge of the second distal portion deflects relative to the first base portion.

8. The lacrosse head of claim 1, wherein each first sidewall hook of the plurality of first sidewall hooks has a straight side on a forward side of the each first sidewall hook such that the each first sidewall hook comprises an L-shaped protrusion when viewed from the side view and defines an inverted L-shaped opening having an interior area and an entrance area, wherein the interior area has a maximum width wider than a width of the entrance area, and wherein the second stringing member is removable through the entrance area of the inverted L-shaped opening defined by the first sidewall hook.

9. The lacrosse head of claim 1, wherein each scoop hook of the plurality of scoop hooks defines a string-retaining gap between a downwardly-facing rear face of the each scoop hook and the upwardly-facing front face of the scoop, wherein the string-retaining gap has a closed rearward end and an open forward end, and wherein the first stringing member is removable through the open forward end of the string-retaining gap.

10. The lacrosse head of claim 9, wherein the scoop defines an opening that extends through the scoop from the front face to the rear face and is disposed under the downwardly-facing rear face of the each scoop hook.

11. The lacrosse head of claim 1, wherein, when viewed from the side view, a rearwardmost first cleat of the plurality of first cleats, as measured from its rearwardly-projecting arm to its forwardly-projecting arm, is wider than remaining first cleats of the plurality of first cleats, and a rearwardmost second cleat of the plurality of second cleats, as measured from its rearwardly-projecting arm to its forwardly-projecting arm, is wider than remaining second cleats of the plurality of second cleats.

12. The lacrosse head of claim 1, wherein the stop member has a plurality of stop member cleats protruding downwardly from a lower edge of the stop member, wherein each stop member cleat has a first arm on a first side of a base portion of the stop member cleat and a second arm a second side of the base portion of the stop member, and wherein the second side of the base portion is opposite to the first side of the base portion.

13. The lacrosse head of claim 1, wherein when viewed from the side view each first cleat of the plurality of first cleats protrudes vertically downward from a lower edge of the first lower portion of the first sidewall, and wherein when viewed from a bottom view of the lacrosse head, each first cleat of the plurality of first cleats is disposed within a profile of a sidewall portion of the lacrosse head, at which the each first cleat is disposed.

14. The lacrosse head of claim 1, wherein when viewed from the side view each first cleat of the plurality of first cleats protrudes vertically upward from a lower rail of the first lower portion of the first sidewall.

15. The lacrosse head of claim 1, wherein the first sidewall has an inside face facing the pocket area and an outside face opposite to the inside face, and wherein when viewed from the side view each first cleat of the plurality of first cleats protrudes horizontally from the outside face of the first lower portion of the first sidewall.

16. The lacrosse head of claim 15, wherein the first lower portion of the first sidewall defines adjacent to the each first cleat an opening extending from the inside face to the outside face, and wherein a stringing member loop of the pocket passes through the opening and then wraps around the each first cleat.

17. The lacrosse head of claim 1, further comprising:

a first anchoring means protruding from the first shoulder portion, wherein the first anchoring means has a forwardly-projecting arm; and a second anchoring means protruding from the second shoulder portion, wherein the second anchoring means has a forwardly-projecting arm.

18. The lacrosse head of claim 17, wherein the scoop has an undercut that defines a passageway from the first anchoring means to the upwardly-facing front face of the scoop, and wherein the passageway routes a stringing member of the pocket from the first anchoring means at the first lower portion of the first sidewall to a scoop hook of the plurality of scoop hooks that is closest to the first anchoring means.

19. The lacrosse head of claim 17, wherein the first anchoring means is disposed within a first corner opening of a first row and a first column of openings of the pocket, wherein the second anchoring means is disposed within a second corner opening of the first row and a second column of openings of the pocket, wherein each scoop hook of the plurality of scoop hooks is disposed within a different intermediate opening of a plurality of intermediate openings of the first row of openings between the first corner opening and the second corner opening, wherein each of the plurality of first sidewall hooks and the plurality of first cleats is disposed within a different opening of the first column of openings, and wherein each of the plurality of second sidewall hooks and the plurality of second cleats is disposed within a different opening of the second column of openings.

20. A lacrosse head comprising:

a juncture configured to receive a handle, the juncture defining a bisecting line when the lacrosse head is viewed from a front view;

a stop member adjoining the juncture;

a first sidewall extending from the stop member in a forward direction and defining a first lower portion when viewed from a side view;

a second sidewall extending from the stop member in the forward direction and defining a second lower portion when viewed from the side view;

a scoop connecting the first sidewall and the second sidewall opposite to the stop member, and, when viewed from the side view, having an upwardly facing front face and a downwardly facing rear face, wherein the stop member, the scoop, the first sidewall, and the second sidewall form a pocket area extending in a rearward-to-forward direction;

a plurality of cleats disposed on the first and second sidewalls in a rearward cleat zone of the pocket area, wherein each cleat has a cleat base portion, a first arm extending from a rearward side of the cleat base portion in a rearward direction parallel to a sidewall portion at which the each cleat is disposed, and a second arm extending from a forward side of the cleat base portion in a forward direction parallel to the sidewall portion at which the each cleat is disposed;

a plurality of sidewall hooks disposed on the first and second sidewalls in a sidewall hook zone of the pocket area disposed forward of the rearward cleat zone, wherein each sidewall hook has a sidewall hook base portion and a hook arm extending from a rearward side of the sidewall hook base portion in a rearward direction parallel to a sidewall portion at which the each sidewall hook is disposed;

a plurality of scoop hooks each of which, when viewed from the side view, protrudes from the front face of the scoop upwardly and in the forward direction and defines a string-retaining cap having a rearward closed end and a forward open end; and a pocket, wherein each cleat of the plurality of cleats removably holds a stringing member of the pocket wrapped around the cleat base portion and within the first arm and the second arm such that the plurality of cleats forms a ball-retaining pocket portion of the pocket, wherein each scoop hook of the plurality of scoop hooks removably holds within the string-retaining gap a stringing member of the pocket that is removable at the forward open end of the string-retaining gap; and wherein the plurality of scoop hooks pulls stringing members of the pocket against the rearward sides of the sidewall hook base portions and within the hook arms, so as to tension the pocket between the scoop and the sidewall hook zone and form in the pocket a ball channel that narrows in the rearward-to-forward direction from a rearward side of the sidewall hook zone to the scoop.

21. The lacrosse head of claim 20, wherein each cleat is T-shaped and each sidewall hook has a straight side on a forward side of the sidewall hook base portion to define an L-shape, wherein a quantity of the plurality of scoop hooks is equal to a total quantity of sidewall hooks minus one, and wherein one scoop hook of the plurality of scoop hooks is disposed on the bisecting line and provides tension between itself and a rearwardmost sidewall hook on each of the first sidewall and the second sidewall.

22. A method for lacrosse head pocket stringing comprising:

providing a preformed pocket having an array of openings;

providing a lacrosse head having:

a juncture configured to receive a handle, the juncture defining a bisecting line when the lacrosse head is viewed from a front view;

a stop member adjoining the juncture;

a first sidewall extending from the stop member in a forward direction and having a first lower portion when viewed from a side view;

a second sidewall extending from the stop member in the forward direction and having a second lower portion when viewed from the side view;

a scoop connecting the first sidewall and the second sidewall opposite to the stop member, and, when viewed from the side view, having an upwardly facing front face and a downwardly facing rear face, wherein the stop member, the scoop, the first sidewall, and the second sidewall form a pocket area extending in a rearward-to-forward direction from a first point on the stop member at the bisecting line to a second point at a distal edge of the scoop at the bisecting line, wherein the scoop and the first sidewall adjoin each other to form a first shoulder portion of the lacrosse head and the scoop and the second sidewall adjoin each other to form a second shoulder portion of the lacrosse head;

a plurality of first cleats protruding from the first lower portion of the first sidewall at a rearward portion of the pocket area nearest the juncture, wherein each first cleat has a rearwardly-projecting arm projecting rearwardly in a direction parallel to the first lower portion of the first sidewall at the rearward portion and a forwardly-projecting arm projecting forwardly in a direction parallel to the first lower portion of the first sidewall at the rearward portion;

a plurality of second cleats protruding from the second lower portion of the second sidewall at the rearward portion of the pocket area nearest the stop member, wherein each second cleat has a rearwardly-projecting arm projecting rearwardly in a direction parallel to the second lower portion of the second sidewall at the rearward portion and a forwardly-projecting arm projecting forwardly in a direction parallel to the second lower portion of the second sidewall at the rearward portion;

a plurality of first sidewall hooks protruding from the first lower portion of the first sidewall at a forward portion of the pocket area forward of the rearward portion, wherein each first sidewall hook has a rearwardly-projecting arm projecting rearwardly in a direction parallel to the first lower portion of the first sidewall at the forward portion;

a plurality of second sidewall hooks protruding from the second lower portion of the second sidewall at the forward portion of the pocket area forward of the rearward portion, wherein each second sidewall hook has a rearwardly-projecting arm projecting rearwardly in a direction parallel to the second lower portion of the second sidewall at the forward portion;

a first anchoring means protruding from the first shoulder portion, wherein the first anchoring means has a rearwardly-projecting arm projecting rearwardly in a direction parallel to the first shoulder portion and a forwardly-projecting arm projecting forwardly in a direction parallel to the first shoulder portion;

a second anchoring means protruding from the second shoulder portion, wherein the second anchoring means has a rearwardly-projecting arm projecting rearwardly in a direction parallel to the second shoulder portion and a forwardly-projecting arm projecting forwardly in a direction parallel to the second shoulder portion; and a plurality of scoop hooks each of which, when viewed from the side view, protrudes from the front face of the scoop upwardly and in the forward direction, and wherein the plurality of scoop hooks includes a first lateral scoop hook disposed on a first side of the bisecting line nearest the first sidewall, and a second lateral scoop hook disposed on a second side of the bisecting line nearest the second sidewall;

removably attaching to the first anchoring means a first stringing member defining a first corner opening of a first row and a first column of openings of the pocket;

removably attaching to the second anchoring means a second stringing member defining a second corner opening of the first row and a second column of openings of the pocket;

removably attaching to each scoop hook of the plurality of scoop hooks a stringing member defining a different intermediate opening of a plurality of intermediate openings of the first row of openings between the first corner opening and the second corner opening;

removably attaching to each of the plurality of first sidewall hooks and the plurality of first cleats a stringing member defining a different opening of the first column of openings; and removably attaching to each of the plurality of second sidewall hooks and the plurality of second cleats a stringing member defining a different opening of the second column of openings;

tensioning the pocket:

from the first lateral scoop hook toward a first sidewall hook of the plurality of first sidewall hooks; and from the second lateral scoop hook toward a second sidewall hook of the plurality of second sidewall hooks, so as to form a ball channel in the pocket; and detaching the pocket from the lacrosse head without untying or cutting any stringing members of the pocket.

23. The method of claim 22, wherein the plurality of scoop hooks includes a center scoop hook disposed on the bisecting line, and wherein the method further comprises tensioning the pocket from the center scoop hook toward a rearwardmost first sidewall hook positioned nearest the juncture and toward a rearwardmost second sidewall hook positioned nearest the juncture.

* * * * *